US007787631B2

(12) United States Patent
Faller

(10) Patent No.: US 7,787,631 B2
(45) Date of Patent: Aug. 31, 2010

(54) PARAMETRIC CODING OF SPATIAL AUDIO WITH CUES BASED ON TRANSMITTED CHANNELS

(75) Inventor: Christof Faller, Tägerwilen (CH)

(73) Assignee: Agere Systems Inc., Allentown, PA (US)

( * ) Notice: Subject to any disclaimer, the term of this patent is extended or adjusted under 35 U.S.C. 154(b) by 1215 days.

(21) Appl. No.: 11/058,747

(22) Filed: Feb. 15, 2005

(65) Prior Publication Data

US 2006/0115100 A1 Jun. 1, 2006

Related U.S. Application Data

(60) Provisional application No. 60/631,917, filed on Nov. 30, 2004.

(51) Int. Cl.
*H04R 5/00* (2006.01)
*G10L 19/00* (2006.01)

(52) U.S. Cl. ..... 381/20; 381/17; 381/18; 381/22; 381/23; 704/500

(58) Field of Classification Search ..... 381/20, 381/17, 18, 19, 21, 22, 23; 700/94; 704/500–502
See application file for complete search history.

(56) References Cited

U.S. PATENT DOCUMENTS

| | | | | |
|---|---|---|---|---|
| 4,236,039 | A | 11/1980 | Cooper | 381/23 |
| 4,815,132 | A | 3/1989 | Minami | 381/1 |
| 4,972,484 | A | 11/1990 | Theile et al. | 704/200.1 |
| 5,371,799 | A | 12/1994 | Lowe et al. | 381/25 |
| 5,463,424 | A | 10/1995 | Dressler | 348/485 |
| 5,579,430 | A | 11/1996 | Grill et al. | 395/2.12 |
| 5,677,994 | A | 10/1997 | Miyamori et al. | 704/501 |
| 5,682,461 | A | 10/1997 | Silzle et al. | 395/2.14 |

(Continued)

FOREIGN PATENT DOCUMENTS

| | | |
|---|---|---|
| CN | 1295778 | 5/2001 |

(Continued)

OTHER PUBLICATIONS

"Advances in Parametric Audio Coding" by Heiko Purnhagen, Proc. 1999 IEEE Workshop on Applications of Signal Processing to Audio and Acoustics, New Paltz, New York, Oct. 17-20, 1999, pp. W99-1-W99-4.

(Continued)

*Primary Examiner*—Vivian Chin
*Assistant Examiner*—Douglas J Suthers
(74) *Attorney, Agent, or Firm*—Mendelsohn, Drucker, & Associates, P.C.; Steve Mendelsohn

(57) ABSTRACT

A binaural cue coding scheme in which cue codes are derived from the transmitted audio signal. In one embodiment, an encoder downmixes C input channels to generate E transmitted channels, where C>E>1. A decoder derives cue codes from the transmitted channels and uses those cue codes to synthesize playback channels. For example, in one 5-to-2 BCC embodiment, the encoder downmixes a 5-channel surround signal to generate left and right channels of a stereo signal. The decoder derives stereo cues from the transmitted stereo signal, maps those stereo cues to surround cues, and applies the surround cues to the transmitted stereo channels to generate playback channels of a 5-channel synthesized surround signal.

47 Claims, 11 Drawing Sheets

U.S. PATENT DOCUMENTS

| | | | | |
|---|---|---|---|---|
| 5,701,346 | A | 12/1997 | Herre et al. | 381/18 |
| 5,706,309 | A | 1/1998 | Eberlein et al. | 375/260 |
| 5,771,295 | A * | 6/1998 | Waller, Jr. | 381/18 |
| 5,812,971 | A | 9/1998 | Herre | 704/230 |
| 5,825,776 | A | 10/1998 | Moon | 370/437 |
| 5,860,060 | A | 1/1999 | Li et al. | 704/500 |
| 5,878,080 | A | 3/1999 | Ten Kate | 375/241 |
| 5,889,843 | A | 3/1999 | Singer et al. | 379/202.01 |
| 5,890,125 | A * | 3/1999 | Davis et al. | 704/501 |
| 5,912,976 | A | 6/1999 | Klayman et al. | 381/18 |
| 5,946,352 | A | 8/1999 | Rowlands et al. | 375/242 |
| 5,956,674 | A | 9/1999 | Smyth et al. | 704/200.1 |
| 6,016,473 | A | 1/2000 | Dolby | 704/500 |
| 6,021,386 | A | 2/2000 | Davis et al. | 704/229 |
| 6,021,389 | A | 2/2000 | Protopapas | 704/278 |
| 6,108,584 | A | 8/2000 | Edwards | 700/94 |
| 6,111,958 | A | 8/2000 | Maher | 381/17 |
| 6,131,084 | A | 10/2000 | Hardwick | 704/230 |
| 6,205,430 | B1 | 3/2001 | Hui | 704/500 |
| 6,282,631 | B1 | 8/2001 | Arbel | 712/35 |
| 6,356,870 | B1 | 3/2002 | Hui et al. | 704/500 |
| 6,408,327 | B1 | 6/2002 | McClennon et al. | 709/204 |
| 6,424,939 | B1 | 7/2002 | Herre et al. | 704/219 |
| 6,434,191 | B1 | 8/2002 | Agrawal et al. | 375/227 |
| 6,539,357 | B1 | 3/2003 | Sinha | 704/270.1 |
| 6,614,936 | B1 | 9/2003 | Wu et al. | 382/238 |
| 6,658,117 | B2 | 12/2003 | Hasebe | 381/61 |
| 6,763,115 | B1 | 7/2004 | Kobayashi | 381/309 |
| 6,782,366 | B1 | 8/2004 | Huang et al. | 704/500 |
| 6,823,018 | B1 | 11/2004 | Jafarkhani et al. | 375/245 |
| 6,845,163 | B1 | 1/2005 | Johnston et al. | 381/92 |
| 6,850,496 | B1 | 2/2005 | Knappe et al. | 370/260 |
| 6,885,992 | B2 | 4/2005 | Mesarovic et al. | |
| 6,934,676 | B2 | 8/2005 | Wang et al. | 704/200.1 |
| 6,940,540 | B2 | 9/2005 | Beal et al. | 348/169 |
| 6,973,184 | B1 | 12/2005 | Shaffer et al. | 379/420.01 |
| 6,987,856 | B1 | 1/2006 | Feng et al. | |
| 7,116,787 | B2 | 10/2006 | Faller | 381/17 |
| 7,181,019 | B2 | 2/2007 | Breebart et al. | |
| 7,382,886 | B2 | 6/2008 | Henn et al. | 381/23 |
| 7,516,066 | B2 | 4/2009 | Schuijers et al. | 704/219 |
| 2001/0031054 | A1 | 10/2001 | Grimani | 381/98 |
| 2001/0031055 | A1 | 10/2001 | Aarts et al. | |
| 2002/0055796 | A1 | 5/2002 | Katayama et al. | 700/94 |
| 2003/0035553 | A1 | 2/2003 | Baumgarte et al. | 381/94.2 |
| 2003/0081115 | A1 | 5/2003 | Curry et al. | 348/14.12 |
| 2003/0161479 | A1 | 8/2003 | Yang et al. | 381/22 |
| 2003/0187663 | A1 | 10/2003 | Truman et al. | 704/500 |
| 2003/0219130 | A1 | 11/2003 | Baumgarte et al. | 381/17 |
| 2003/0236583 | A1 | 12/2003 | Baumgarte et al. | 700/94 |
| 2004/0091118 | A1 | 5/2004 | Griesinger | 381/20 |
| 2005/0053242 | A1 | 3/2005 | Henn et al. | 381/22 |
| 2005/0069143 | A1 | 3/2005 | Budnikov et al. | 381/63 |
| 2005/0157883 | A1 | 7/2005 | Herre et al. | 381/17 |
| 2005/0226426 | A1 | 10/2005 | Oomen et al. | 381/23 |
| 2006/0206323 | A1 | 9/2006 | Breebaart | 704/230 |
| 2007/0094012 | A1 | 4/2007 | Pang et al. | |

FOREIGN PATENT DOCUMENTS

| | | | |
|---|---|---|---|
| EP | 1 107 232 | A2 | 6/2001 |
| EP | 1 376 538 | A1 | 1/2004 |
| EP | 1 479 071 | B1 | 1/2006 |
| JP | 07123008 | | 5/1995 |
| JP | H10-051313 | | 2/1998 |
| JP | 2004-535145 | A | 11/2004 |
| RU | 2214048 | C2 | 10/2003 |
| TW | 347623 | | 12/1998 |
| TW | 444511 | | 7/2001 |
| TW | 510144 | | 11/2002 |
| TW | 517223 | | 1/2003 |
| TW | 521261 | | 2/2003 |
| WO | WO 03/007656 | A1 | 1/2003 |
| WO | WO 03/090207 | A1 | 10/2003 |
| WO | WO 03/090208 | A1 | 10/2003 |
| WO | WO 03/094369 | A2 | 11/2003 |
| WO | WO 2004/008806 | A1 | 1/2004 |
| WO | WO 2004/049309 | A1 | 6/2004 |
| WO | WO 2004/072956 | A1 | 8/2004 |
| WO | WO 2004/077884 | A1 | 9/2004 |
| WO | WO 2004/086817 | A2 | 10/2004 |
| WO | WO 2005/069274 | A1 | 7/2005 |

OTHER PUBLICATIONS

"Surround Sound Past, Present, and Future" by Joseph Hull; Dolby Laboratories Inc.; 1999; 8 pages.

"*Final text for DIS 11172-1 (rev. 2): Information Technology-Coding of Moving Pictures and Associated Audio for Digital Storage Media—Part 1*," ISO/LEC JTC 1/SC 29 N 147, Apr. 20, 1992, Section 3: Audio, XP-002083108, 2 pages.

"Binaural Cue Coding—Part I: Psychoacoustic Fundamentals and Design Principles", by Frank Baumgrate et al., IEEE Transactions on Speech and Audio Processing, vol. II, No. 6, Nov. 2003, pp. 509-519.

"Binaural Cue Coding—Part II: Schemes and Applications", by Christof Faller et al., IEEE Transactions on Speech and Audio Processing, vol. II, No. 6, Nov. 2003, pp. 520-531.

"Low Complexity Parametric Stereo Coding", by Erik Schuijers et al., Audio Engineering Society 116$^{th}$ Convention Paper 6073, May 8-11, 2004, Berlin, Germany, pp. 1-11.

"MP3 Surround: Efficient and Compatible Coding of Multi-Channel Audio", by Juergen Herre et al., Audio Engineering Society 116$^{th}$ Convention Paper, May 8-11, 2004, Berlin, Germany, pp. 1-14.

"Coding of Spatial Audio Compatible With Different Playback Formats", by Christof Faller, Audio Engineering Society 117$^{th}$ Convention, San Francisco, CA, Oct. 28-31, 2004, pp. 1-12.

"Advances in Parametric Coding for High-Quality Audio," by Erik Schuijers et al., Audio Engineering Society Convention Paper 5852, 114$^{th}$ Convention, Amsterdam, The Netherlands, Mar. 22-25, 2003, pp. 1-11.

"Advances in Parametric Coding for High-Quality Audio," by E.G.P. Schuijers et al., Proc. 1$^{st}$ IEEE Benelux Workshop on Model Based Processing and Coding of Audio (MPCA-2002), Leuven, Belgium, Nov. 15, 2002, pp. 73-79, XP001156065.

"Improving Audio Codecs by Noise Substitution," by Donald Schulz, Journal of the Audio Engineering Society, vol. 44, No. 7/8, Jul./Aug. 1996, pp. 593-598, XP000733647.

"The Reference Model Architecture for MPEG Spatial Audio Coding," by Juergen Herre et al., Audio Engineering Society Convention Paper 6447, 118$^{th}$ Convention, May 28-31, 2005, Barcelona, Spain, pp. 1-13, XP009059973.

"From Joint Stereo to Spatial Audio Coding—Recent Progress and Standardization," by Jurgen Herre, Proc. of the 7$^{th}$ Int. Conference on Digital Audio Effects (DAFx'04), Oct. 5-8, 2004, Naples, Italy, XP002367849.

"Parametric Coding of Spatial Audio," by Christof Faller, Proc. of the 7$^{th}$ Int. Conference on Digital Audio Effects (DAFx'04), Oct. 5-8, 2004, Naples, Itlay, XP002367850.

"Parametric Coding of Spatial Audio—Thesis No. 3062," by Christof Faller, These Presentee a La Faculte Informatique et Communications Institit De Systemes De Communication Section Des Systems De Communication Ecole Polytechnique Fédérale De Lausanne Pour L'Obtention Du Grade De Docteur Es Sciences, Jul. 2004, XP002343263, Laussane, Section 5.3, pp. 71-84.

"Spatial Audio Coding: Next-generation efficient and compatible coding of multi-channel audio," Juergen Herre et al., Audio Engineering Society Convention Paper 117$^{th}$ Convention, Oct. 28-31, 2004, San Francisco, CA, pp. 1-13, XP002343375.

"Binaural Cue Coding Applied to Stereo and Multi-Channel Audio Compression," by Christof Faller et al., Audio Engineering Society 112$^{th}$ Covention, Munich, Germany, vol. 112, No. 5574, May 10, 2002, pp. 1-9.

"MP3 Surround: Efficient and Compatible Coding of Multi-Channel Audio", by Juergen Herre et al., Audio Engineering Society 116$^{th}$ Convention Paper, May 8-11, 2004, Berlin, Germany, pp. 1-14.

"MPEG Audio Layer II: A Generic Coding Standard For Two And Multichannel Sound For DVB, DAB and Computer Multimedia," by G. Stoll, International Broadcasting Convention, Sep. 14-18, 1995, Germany, XP006528918, pp. 136-144.

"Binaural Cue Coding: Rendering of Sources Mixed into a Mono Signal" by Christof Faller, Media Signal Processing Research, Agere Systems, Allentown, PA, USA, Mar. 2003, 2 pages.

"HILN- The MPEG-4 Parametric Audio Coding Tools" by Heiko Purnhagen and Nikolaus Meine, University of Hannover, Hannover, Germany, 2000, 4 pages.

"Parametric Audio Coding" by Bernd Edler and Heiko Purnhagen, University of Hannover, Hannover, Germany, 2000, pp. 1-4.

"Multichannel Natural Music Recording Based on Psychoacoustic Principles", by Gunther Theile, Extended version of the paper presented at the AES 19$^{th}$ International Conference, May 2001, Oct. 2001, pp. 1-45.

Office Action for Japanese Patent Application No. 2007-537133 dated Feb. 16, 2010 received on Mar. 10, 2010.

Christof Faller, "Parametric Coding of Spatial Audio, These No. 3062," Presentee A La Faculte Informatique et Communications, Institut de Systemes de Communication, Ecole Polytechnique Federale de Lausanne, Lausanne, EPFL 2004.

* cited by examiner

PARAMETRIC CODING OF SPATIAL AUDIO WITH CUES BASED ON TRANSMITTED CHANNELS

CROSS-REFERENCE TO RELATED APPLICATIONS

This application claims the benefit of the filing date of U.S. provisional application No. 60/631,917, filed on Nov. 30, 2004, the teachings of which are incorporated herein by reference.

The subject matter of this application is related to the subject matter of the following U.S. applications, the teachings of all of which are incorporated herein by reference:

- U.S. application Ser. No. 09/848,877, filed on May 4, 2001;
- U.S. application Ser. No. 10/045,458, filed on Nov. 7, 2001, which itself claimed the benefit of the filing date of U.S. provisional application No. 60/311,565, filed on Aug. 10, 2001;
- U.S. application Ser. No. 10/155,437, filed on May 24, 2002;
- U.S. application Ser. No. 10/246,570, filed on Sep. 18, 2002;
- U.S. application Ser. No. 10/815,591, filed on Apr. 1, 2004;
- U.S. application Ser. No. 10/936,464, filed on Sep. 8, 2004;
- U.S. application Ser. No. 10/762,100, filed on Jan. 20, 2004;
- U.S. application Ser. No. 11/006,492, filed on Dec. 7, 2004;
- U.S. application Ser. No. 11/006,482, filed on Dec. 7, 2004; and
- U.S. application Ser. No. 11/032,689, filed on Jan. 10, 2005.

The subject matter of this application is also related to subject matter described in the following papers, the teachings of all of which are incorporated herein by reference:

- F. Baumgarte and C. Faller, "Binaural Cue Coding—Part I: Psychoacoustic fundamentals and design principles," *IEEE Trans. on Speech and Audio Proc.*, vol. 11, no. 6, November 2003;
- C. Faller and F. Baumgarte, "Binaural Cue Coding—Part II: Schemes and applications," *IEEE Trans. on Speech and Audio Proc.*, vol. 11, no. 6, November 2003; and
- C. Faller, "Coding of spatial audio compatible with different playback formats," *Preprint* 117$^{th}$ *Conv. Aud. Eng. Soc.,* October 2004.

BACKGROUND OF THE INVENTION

1. Field of the Invention

The present invention relates to the encoding of audio signals and the subsequent synthesis of auditory scenes from the encoded audio data.

2. Description of the Related Art

When a person hears an audio signal (i.e., sounds) generated by a particular audio source, the audio signal will typically arrive at the person's left and right ears at two different times and with two different audio (e.g., decibel) levels, where those different times and levels are functions of the differences in the paths through which the audio signal travels to reach the left and right ears, respectively. The person's brain interprets these differences in time and level to give the person the perception that the received audio signal is being generated by an audio source located at a particular position (e.g., direction and distance) relative to the person. An auditory scene is the net effect of a person simultaneously hearing audio signals generated by one or more different audio sources located at one or more different positions relative to the person.

The existence of this processing by the brain can be used to synthesize auditory scenes, where audio signals from one or more different audio sources are purposefully modified to generate left and right audio signals that give the perception that the different audio sources are located at different positions relative to the listener.

FIG. 1 shows a high-level block diagram of conventional binaural signal synthesizer 100, which converts a single audio source signal (e.g., a mono signal) into the left and right audio signals of a binaural signal, where a binaural signal is defined to be the two signals received at the eardrums of a listener. In addition to the audio source signal, synthesizer 100 receives a set of spatial cues corresponding to the desired position of the audio source relative to the listener. In typical implementations, the set of spatial cues comprises an inter-channel level difference (ICLD) value (which identifies the difference in audio level between the left and right audio signals as received at the left and right ears, respectively) and an inter-channel time difference (ICTD) value (which identifies the difference in time of arrival between the left and right audio signals as received at the left and right ears, respectively). In addition or as an alternative, some synthesis techniques involve the modeling of a direction-dependent transfer function for sound from the signal source to the eardrums, also referred to as the head-related transfer function (HRTF). See, e.g., J. Blauert, *The Psychophysics of Human Sound Localization*, MIT Press, 1983, the teachings of which are incorporated herein by reference.

Using binaural signal synthesizer 100 of FIG. 1, the mono audio signal generated by a single sound source can be processed such that, when listened to over headphones, the sound source is spatially placed by applying an appropriate set of spatial cues (e.g., ICLD, ICTD, and/or HRTF) to generate the audio signal for each ear. See, e.g., D. R. Begault, 3-*D Sound for Virtual Reality and Multimedia*, Academic Press, Cambridge, Mass., 1994.

Binaural signal synthesizer 100 of FIG. 1 generates the simplest type of auditory scenes: those having a single audio source positioned relative to the listener. More complex auditory scenes comprising two or more audio sources located at different positions relative to the listener can be generated using an auditory scene synthesizer that is essentially implemented using multiple instances of binaural signal synthesizer, where each binaural signal synthesizer instance generates the binaural signal corresponding to a different audio source. Since each different audio source has a different location relative to the listener, a different set of spatial cues is used to generate the binaural audio signal for each different audio source.

SUMMARY OF THE INVENTION

According to one embodiment, the present invention is a method, apparatus, and machine-readable medium for synthesizing C playback audio channels from E transmitted audio channels, where C>E>1. One or more cues are derived from the E transmitted channels, one or more of the E transmitted channels are upmixed to generate one or more upmixed channels, and one or more of the C playback channels are synthesized from the one or more upmixed channels based on the one or more derived cues.

According to another embodiment, the present invention is a method, apparatus, and machine-readable medium for generating E transmitted audio channels from C input audio channels, where C>E>1. A direction is estimated for an auditory event in the C input channels, and a downmixing algorithm is applied to the C input channels to generate the E transmitted channels, wherein the downmixing algorithm is based on the auditory event direction.

According to another embodiment, the present invention is a bitstream generated by applying a panning law to generate a downmixing algorithm based on a mapping from an input-channel domain to a transmitted-channel domain, and applying the downmixing algorithm to the C input channels to generate the E transmitted channels.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Figure 1:
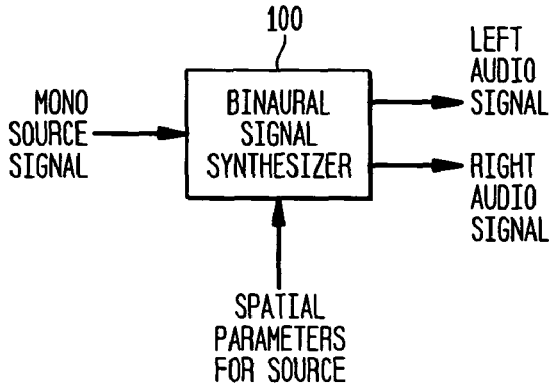
FIG. 1 (PRIOR ART)
FIG. 1 shows a high-level block diagram of conventional binaural signal synthesizer.

In binaural cue coding (BCC), an encoder encodes C input audio channels to generate E transmitted audio channels, where C>E≧1. In particular, two or more of the C input channels are provided in a frequency domain, and one or more cue codes are generated for each of one or more different frequency bands in the two or more input channels in the frequency domain. In addition, the C input channels are downmixed to generate the E transmitted channels. In some downmixing implementations, at least one of the E transmitted channels is based on two or more of the C input channels, and at least one of the E transmitted channels is based on only a single one of the C input channels.

In one embodiment, a BCC coder has two or more filter banks, a code estimator, and a downmixer. The two or more filter banks convert two or more of the C input channels from a time domain into a frequency domain. The code estimator generates one or more cue codes for each of one or more different frequency bands in the two or more converted input channels. The downmixer downmixes the C input channels to generate the E transmitted channels, where C>E≧1.

In BCC decoding, E transmitted audio channels are decoded to generate C playback (i.e., synthesized) audio channels. In particular, for each of one or more different frequency bands, one or more of the E transmitted channels are upmixed in a frequency domain to generate two or more of the C playback channels in the frequency domain, where C>E≧1. One or more cue codes are applied to each of the one or more different frequency bands in the two or more playback channels in the frequency domain to generate two or more modified channels, and the two or more modified channels are converted from the frequency domain into a time domain. In some upmixing implementations, at least one of the C playback channels is based on at least one of the E transmitted channels and at least one cue code, and at least one of the C playback channels is based on only a single one of the E transmitted channels and independent of any cue codes.

In one embodiment, a BCC decoder has an upmixer, a synthesizer, and one or more inverse filter banks. For each of one or more different frequency bands, the upmixer upmixes one or more of the E transmitted channels in a frequency domain to generate two or more of the C playback channels in the frequency domain, where C>E≧1. The synthesizer applies one or more cue codes to each of the one or more different frequency bands in the two or more playback channels in the frequency domain to generate two or more modified channels. The one or more inverse filter banks convert the two or more modified channels from the frequency domain into a time domain.

Depending on the particular implementation, a given playback channel may be based on a single transmitted channel, rather than a combination of two or more transmitted channels. For example, when there is only one transmitted channel, each of the C playback channels is based on that one transmitted channel. In these situations, upmixing corresponds to copying of the corresponding transmitted channel. As such, for applications in which there is only one transmitted channel, the upmixer may be implemented using a replicator that copies the transmitted channel for each playback channel.

BCC encoders and/or decoders may be incorporated into a number of systems or applications including, for example, digital video recorders/players, digital audio recorders/players, computers, satellite transmitters/receivers, cable transmitters/receivers, terrestrial broadcast transmitters/receivers, home entertainment systems, and movie theater systems.

Generic BCC Processing

Figure 2:
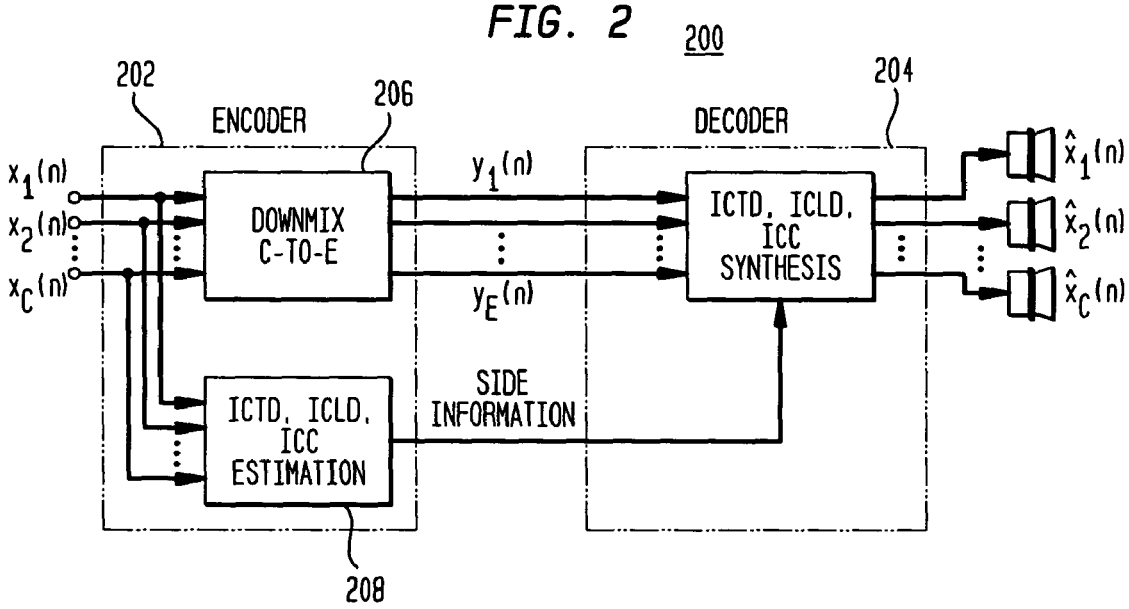
FIG. 2 is a block diagram of a generic binaural cue coding (BCC) audio processing system.

FIG. 2 is a block diagram of a generic binaural cue coding (BCC) audio processing system 200 comprising an encoder 202 and a decoder 204. Encoder 202 includes downmixer 206 and BCC estimator 208.

Downmixer 206 converts C input audio channels $x_i(n)$ into E transmitted audio channels $y_i(n)$, where $C>E\geqq 1$. In this specification, signals expressed using the variable n are time-domain signals, while signals expressed using the variable k are frequency-domain signals. Depending on the particular implementation, downmixing can be implemented in either the time domain or the frequency domain. BCC estimator 208 generates BCC codes from the C input audio channels and transmits those BCC codes as either in-band or out-of-band side information relative to the E transmitted audio channels. Typical BCC codes include one or more of inter-channel time difference (ICTD), inter-channel level difference (ICLD), and inter-channel correlation (ICC) data estimated between certain pairs of input channels as a function of frequency and time. The particular implementation will dictate between which particular pairs of input channels, BCC codes are estimated.

ICC data corresponds to the coherence of a binaural signal, which is related to the perceived width of the audio source. The wider the audio source, the lower the coherence between the left and right channels of the resulting binaural signal. For example, the coherence of the binaural signal corresponding to an orchestra spread out over an auditorium stage is typically lower than the coherence of the binaural signal corresponding to a single violin playing solo. In general, an audio signal with lower coherence is usually perceived as more spread out in auditory space. As such, ICC data is typically related to the apparent source width and degree of listener envelopment. See, e.g., J. Blauert, *The Psychophysics of Human Sound Localization*, MIT Press, 1983.

Depending on the particular application, the E transmitted audio channels and corresponding BCC codes may be transmitted directly to decoder 204 or stored in some suitable type of storage device for subsequent access by decoder 204. Depending on the situation, the term "transmitting" may refer to either direct transmission to a decoder or storage for subsequent provision to a decoder. In either case, decoder 204 receives the transmitted audio channels and side information and performs upmixing and BCC synthesis using the BCC codes to convert the E transmitted audio channels into more than E (typically, but not necessarily, C) playback audio channels $\hat{x}_i(n)$ for audio playback. Depending on the particular implementation, upmixing can be performed in either the time domain or the frequency domain.

In addition to the BCC processing shown in FIG. 2, a generic BCC audio processing system may include additional encoding and decoding stages to further compress the audio signals at the encoder and then decompress the audio signals at the decoder, respectively. These audio codecs may be based on conventional audio compression/decompression techniques such as those based on pulse code modulation (PCM), differential PCM (DPCM), or adaptive DPCM (ADPCM).

When downmixer 206 generates a single sum signal (i.e., E=1), BCC coding is able to represent multi-channel audio signals at a bitrate only slightly higher than what is required to represent a mono audio signal. This is so, because the estimated ICTD, ICLD, and ICC data between a channel pair contain about two orders of magnitude less information than an audio waveform.

Not only the low bitrate of BCC coding, but also its backwards compatibility aspect is of interest. A single transmitted sum signal corresponds to a mono downmix of the original stereo or multi-channel signal. For receivers that do not support stereo or multi-channel sound reproduction, listening to the transmitted sum signal is a valid method of presenting the audio material on low-profile mono reproduction equipment. BCC coding can therefore also be used to enhance existing services involving the delivery of mono audio material towards multi-channel audio. For example, existing mono audio radio broadcasting systems can be enhanced for stereo or multi-channel playback if the BCC side information can be embedded into the existing transmission channel. Analogous capabilities exist when downmixing multi-channel audio to two sum signals that correspond to stereo audio.

BCC processes audio signals with a certain time and frequency resolution. The frequency resolution used is largely motivated by the frequency resolution of the human auditory system. Psychoacoustics suggests that spatial perception is most likely based on a critical band representation of the acoustic input signal. This frequency resolution is considered by using an invertible filterbank (e.g., based on a fast Fourier transform (FFT) or a quadrature mirror filter (QMF)) with subbands with bandwidths equal or proportional to the critical bandwidth of the human auditory system.

Generic Downmixing

In preferred implementations, the transmitted sum signal(s) contain all signal components of the input audio signal. The goal is that each signal component is fully maintained. Simply summation of the audio input channels often results in amplification or attenuation of signal components. In other words, the power of the signal components in a "simple" sum is often larger or smaller than the sum of the power of the corresponding signal component of each channel. A downmixing technique can be used that equalizes the sum signal such that the power of signal components in the sum signal is approximately the same as the corresponding power in all input channels.

Figure 3:
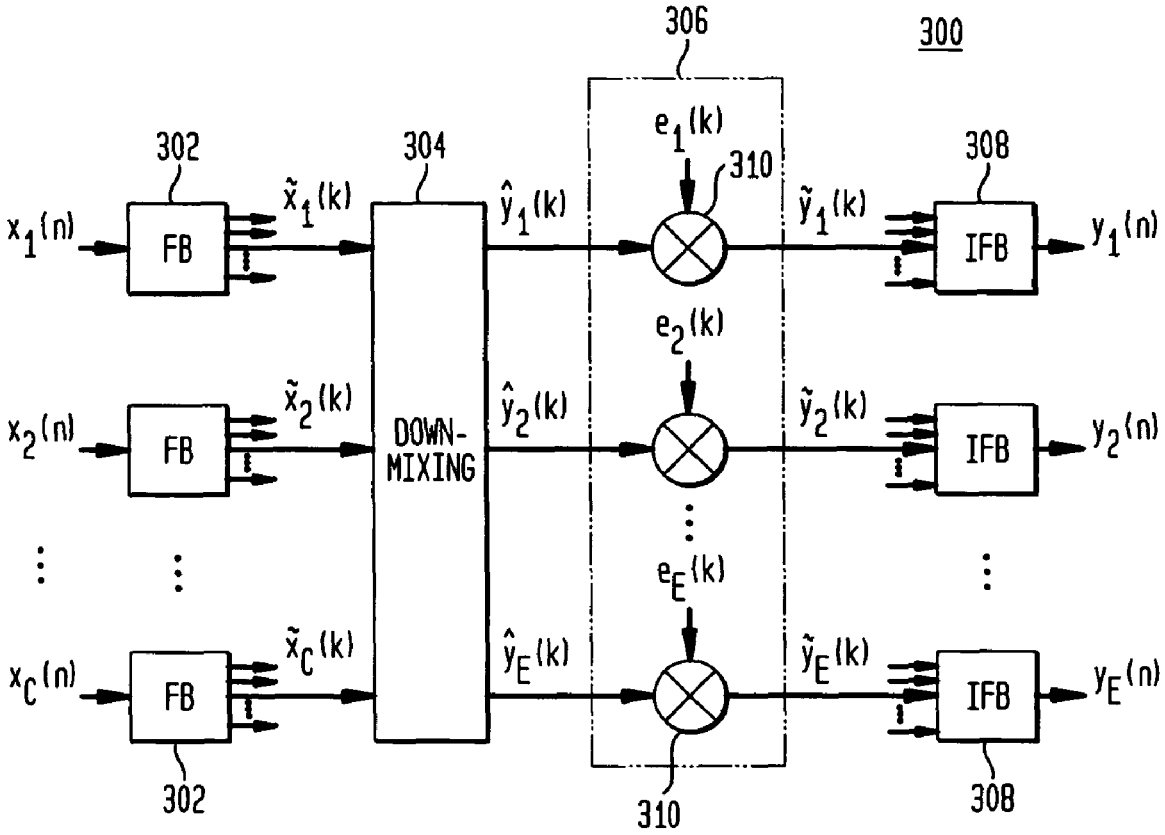
FIG. 3 shows a block diagram of a downmixer that can be used for the downmixer of FIG. 2.

FIG. 3 shows a block diagram of a downmixer 300 that can be used for downmixer 206 of FIG. 2 according to certain implementations of BCC system 200. Downmixer 300 has a filter bank (FB) 302 for each input channel $x_i(n)$, a downmixing block 304, an optional scaling/delay block 306, and an inverse FB(IFB) 308 for each encoded channel $y_i(n)$.

Each filter bank 302 converts each frame (e.g., 20 msec) of a corresponding digital input channel $x_i(n)$ in the time domain into a set of input coefficients $\tilde{x}_i(k)$ in the frequency domain. Downmixing block 304 downmixes each sub-band of C corresponding input coefficients into a corresponding sub-band of E downmixed frequency-domain coefficients. Equation (1) represents the downmixing of the kth sub-band of input coefficients $(\tilde{x}_1(k), \tilde{x}_2(k), \ldots, \tilde{x}_C(k))$ to generate the kth sub-band of downmixed coefficients $(\hat{y}_1(k), \hat{y}_2(k), \ldots, \hat{y}_E(k))$ as follows:

$$\begin{bmatrix} \hat{y}_1(k) \\ \hat{y}_2(k) \\ \vdots \\ \hat{y}_E(k) \end{bmatrix} = D_{CE} \begin{bmatrix} \tilde{x}_1(k) \\ \tilde{x}_2(k) \\ \vdots \\ \tilde{x}_C(k) \end{bmatrix}, \tag{1}$$

where $D_{CE}$ is a real-valued C-by-E downmixing matrix.

Optional scaling/delay block 306 comprises a set of multipliers 310, each of which multiplies a corresponding downmixed coefficient $\hat{y}_i(k)$ by a scaling factor $e_i(k)$ to generate a corresponding scaled coefficient $\tilde{y}_i(k)$. The motivation for the scaling operation is equivalent to equalization generalized for downmixing with arbitrary weighting factors for each channel. If the input channels are independent, then the power $p_{y_i(k)}$ of the downmixed signal in each sub-band is given by Equation (2) as follows:

$$\begin{bmatrix} p_{\tilde{y}_1(k)} \\ p_{\tilde{y}_2(k)} \\ \vdots \\ p_{\tilde{y}_E(k)} \end{bmatrix} = \overline{D}_{CE} \begin{bmatrix} p_{\tilde{x}_1(k)} \\ p_{\tilde{x}_2(k)} \\ \vdots \\ p_{\tilde{x}_C(k)} \end{bmatrix}, \tag{2}$$

where $\overline{D}_{CE}$ is derived by squaring each matrix element in the C-by-E downmixing matrix $D_{CE}$ and $p_{x_i(k)}$ is the power of sub-band k of input channel i.

If the sub-bands are not independent, then the power values $p_{y_i(k)}$ of the downmixed signal will be larger or smaller than that computed using Equation (2), due to signal amplifications or cancellations when signal components are in-phase or out-of-phase, respectively. To prevent this, the downmixing operation of Equation (1) is applied in sub-bands followed by the scaling operation of multipliers 310. The scaling factors $e_i(k)$ ($1 \leqq i \leqq E$) can be derived using Equation (3) as follows:

$$e_i(k) = \sqrt{\frac{p_{\tilde{y}_i(k)}}{p_{\hat{y}_i(k)}}}, \tag{3}$$

where $p_{y_i(k)}$ is the sub-band power as computed by Equation (2), and $p_{\tilde{y}_i(k)}$ is power of the corresponding downmixed sub-band signal $\hat{y}_i(k)$.

In addition to or instead of providing optional scaling, scaling/delay block 306 may optionally apply delays to the signals.

Each inverse filter bank 308 converts a set of corresponding scaled coefficients $\tilde{y}_i(k)$ in the frequency domain into a frame of a corresponding digital, transmitted channel $y_i(n)$.

Although FIG. 3 shows all C of the input channels being converted into the frequency domain for subsequent downmixing, in alternative implementations, one or more (but less than C−1) of the C input channels might bypass some or all of the processing shown in FIG. 3 and be transmitted as an equivalent number of unmodified audio channels. Depending on the particular implementation, these unmodified audio channels might or might not be used by BCC estimator 208 of FIG. 2 in generating the transmitted BCC codes.

In an implementation of downmixer 300 that generates a single sum signal y(n), E=1 and the signals $\tilde{x}_c(k)$ of each subband of each input channel c are added and then multiplied with a factor e(k), according to Equation (4) as follows:

$$\tilde{y}(k) = e(k) \sum_{c=1}^{C} \tilde{x}_c(k). \tag{4}$$

the factor e(k) is given by Equation (5) as follows:

$$e(k) = \sqrt{\frac{\sum_{c=1}^{C} p_{\tilde{x}_c}(k)}{p_{\tilde{x}}(k)}}, \tag{5}$$

where $p_{x_c}(k)$ is a short-time estimate of the power of $\tilde{x}_c(k)$ at time index k, and $p_x(k)$ is a short-time estimate of the power of $$\sum_{c=1}^{C} \tilde{x}_c(k).$$

The equalized subbands are transformed back to the time domain resulting in the sum signal y(n) that is transmitted to the BCC decoder.

Generic BCC Synthesis

Figure 4:
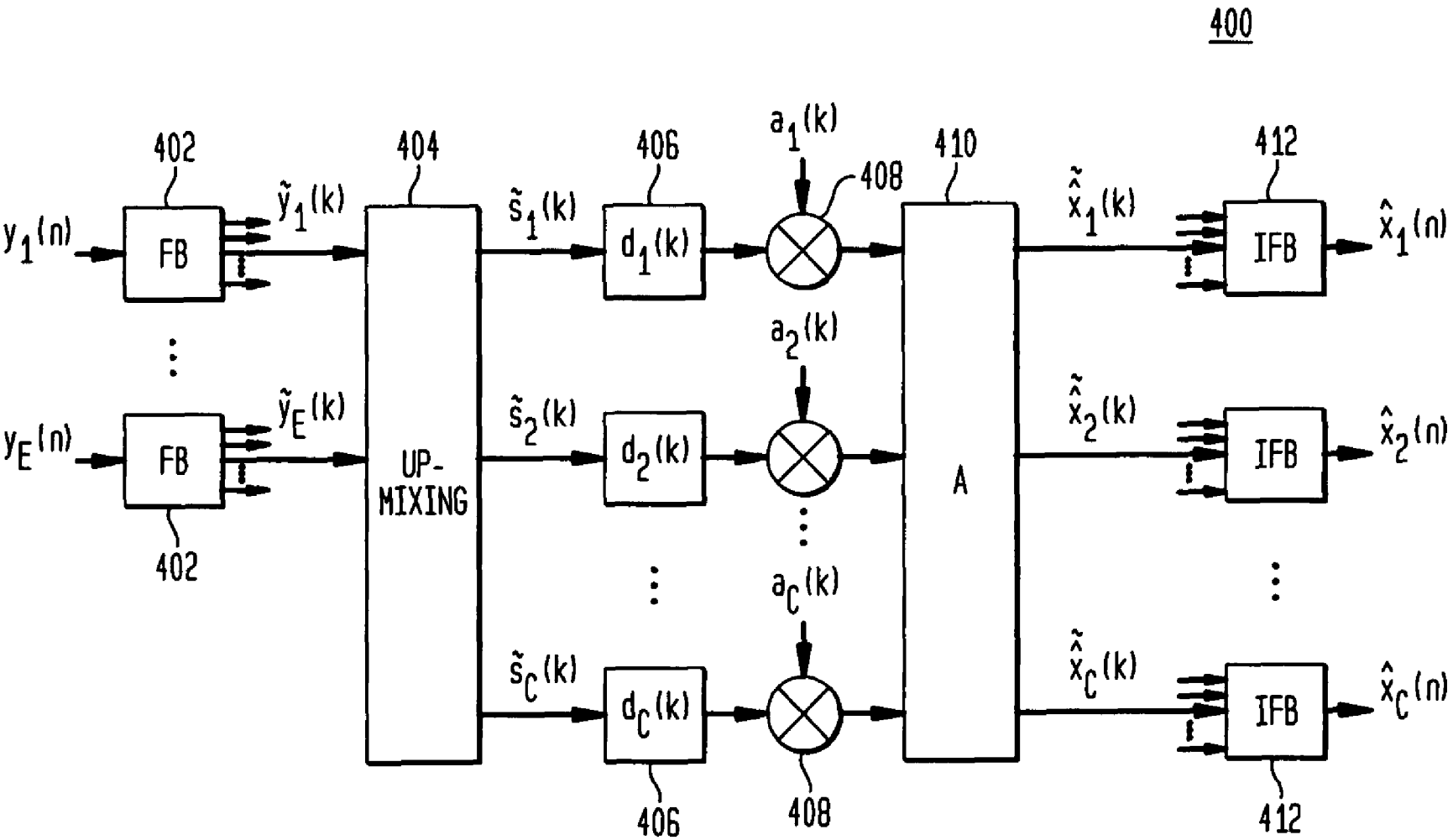
FIG. 4 shows a block diagram of a BCC synthesizer that can be used for the decoder of FIG. 2.

FIG. 4 shows a block diagram of a BCC synthesizer 400 that can be used for decoder 204 of FIG. 2 according to certain implementations of BCC system 200. BCC synthesizer 400 has a filter bank 402 for each transmitted channel $y_i(n)$, an upmixing block 404, delays 406, multipliers 408, de-correlation block 410, and an inverse filter bank 412 for each playback channel $\hat{x}_i(n)$.

Each filter bank 402 converts each frame of a corresponding digital, transmitted channel $\tilde{y}_i(n)$ in the time domain into a set of input coefficients $\tilde{y}_i(k)$ in the frequency domain. Upmixing block 404 upmixes each sub-band of E corresponding transmitted-channel coefficients into a corresponding sub-band of C upmixed frequency-domain coefficients. Equation (4) represents the upmixing of the kth sub-band of transmitted-channel coefficients ($\tilde{y}_1(k), \tilde{y}_2(k), \ldots, \tilde{y}_E(k)$) to generate the kth sub-band of upmixed coefficients ($\tilde{s}_1(k), \tilde{s}_2(k), \ldots, \tilde{s}_C(k)$) as follows:

$$\begin{bmatrix} \tilde{s}_1(k) \\ \tilde{s}_2(k) \\ \vdots \\ \tilde{s}_C(k) \end{bmatrix} = U_{EC} \begin{bmatrix} \tilde{y}_1(k) \\ \tilde{y}_2(k) \\ \vdots \\ \tilde{y}_E(k) \end{bmatrix}, \tag{6}$$

where $U_{EC}$ is a real-valued E-by-C upmixing matrix. Performing upmixing in the frequency-domain enables upmixing to be applied individually in each different sub-band.

Each delay 406 applies a delay value $d_i(k)$ based on a corresponding BCC code for ICTD data to ensure that the desired ICTD values appear between certain pairs of playback channels. Each multiplier 408 applies a scaling factor $a_i(k)$ based on a corresponding BCC code for ICLD data to ensure that the desired ICLD values appear between certain pairs of playback channels. De-correlation block 410 performs a de-correlation operation A based on corresponding BCC codes for ICC data to ensure that the desired ICC values appear between certain pairs of playback channels. Further description of the operations of de-correlation block 410 can be found in U.S. patent application Ser. No. 10/155,437, filed on May 24, 2002 as Baumgarte 2-10.

The synthesis of ICLD values may be less troublesome than the synthesis of ICTD and ICC values, since ICLD synthesis involves merely scaling of sub-band signals. Since ICLD cues are the most commonly used directional cues, it is usually more important that the ICLD values approximate those of the original audio signal. As such, ICLD data might be estimated between all channel pairs. The scaling factors $a_i(k)$ ($1 \leqq i \leqq C$) for each sub-band are preferably chosen such that the sub-band power of each playback channel approximates the corresponding power of the original input audio channel.

One goal may be to apply relatively few signal modifications for synthesizing ICTD and ICC values. As such, the BCC data might not include ICTD and ICC values for all channel pairs. In that case, BCC synthesizer 400 would synthesize ICTD and ICC values only between certain channel pairs.

Each inverse filter bank 412 converts a set of corresponding synthesized coefficients $\hat{x}_i(k)$ in the frequency domain into a frame of a corresponding digital, playback channel $\hat{x}_i(n)$.

Although FIG. 4 shows all E of the transmitted channels being converted into the frequency domain for subsequent upmixing and BCC processing, in alternative implementations, one or more (but not all) of the E transmitted channels might bypass some or all of the processing shown in FIG. 4. For example, one or more of the transmitted channels may be unmodified channels that are not subjected to any upmixing. In addition to being one or more of the C playback channels, these unmodified channels, in turn, might be, but do not have to be, used as reference channels to which BCC processing is applied to synthesize one or more of the other playback channels. In either case, such unmodified channels may be subjected to delays to compensate for the processing time involved in the upmixing and/or BCC processing used to generate the rest of the playback channels.

Note that, although FIG. 4 shows C playback channels being synthesized from E transmitted channels, where C was also the number of original input channels, BCC synthesis is not limited to that number of playback channels. In general, the number of playback channels can be any number of channels, including numbers greater than or less than C and possibly even situations where the number of playback channels is equal to or less than the number of transmitted channels.

"Perceptually Relevant Differences" Between Audio Channels

Assuming a single sum signal, BCC synthesizes a stereo or multi-channel audio signal such that ICTD, ICLD, and ICC approximate the corresponding cues of the original audio signal. In the following, the role of ICTD, ICLD, and ICC in relation to auditory spatial image attributes is discussed.

Knowledge about spatial hearing implies that for one auditory event, ICTD and ICLD are related to perceived direction. When considering binaural room impulse responses (BRIRs) of one source, there is a relationship between width of the auditory event and listener envelopment and ICC data estimated for the early and late parts of the BRIRs. However, the relationship between ICC and these properties for general signals (and not just the BRIRs) is not straightforward.

Stereo and multi-channel audio signals usually contain a complex mix of concurrently active source signals superimposed by reflected signal components resulting from recording in enclosed spaces or added by the recording engineer for artificially creating a spatial impression. Different source signals and their reflections occupy different regions in the time-frequency plane. This is reflected by ICTD, ICLD, and ICC, which vary as a function of time and frequency. In this case, the relation between instantaneous ICTD, ICLD, and ICC and auditory event directions and spatial impression is not obvious. The strategy of certain embodiments of BCC is to blindly synthesize these cues such that they approximate the corresponding cues of the original audio signal.

Filterbanks with subbands of bandwidths equal to two times the equivalent rectangular bandwidth (ERB) are used. Informal listening reveals that the audio quality of BCC does not notably improve when choosing higher frequency resolution. A lower frequency resolution may be desired, since it results in less ICTD, ICLD, and ICC values that need to be transmitted to the decoder and thus in a lower bitrate.

Regarding time resolution, ICTD, ICLD, and ICC are typically considered at regular time intervals. High performance is obtained when ICTD, ICLD, and ICC are considered about every 4 to 16 ms. Note that, unless the cues are considered at very short time intervals, the precedence effect is not directly considered. Assuming a classical lead-lag pair of sound stimuli, if the lead and lag fall into a time interval where only one set of cues is synthesized, then localization dominance of the lead is not considered. Despite this, BCC achieves audio quality reflected in an average MUSHRA score of about 87 (i.e., "excellent" audio quality) on average and up to nearly 100 for certain audio signals.

The often-achieved perceptually small difference between reference signal and synthesized signal implies that cues related to a wide range of auditory spatial image attributes are implicitly considered by synthesizing ICTD, ICLD, and ICC at regular time intervals. In the following, some arguments are given on how ICTD, ICLD, and ICC may relate to a range of auditory spatial image attributes.

Estimation of Spatial Cues

In the following, it is described how ICTD, ICLD, and ICC are estimated. The bitrate for transmission of these (quantized and coded) spatial cues can be just a few kb/s and thus, with BCC, it is possible to transmit stereo and multi-channel audio signals at bitrates close to what is required for a single audio channel.

Figure 5:
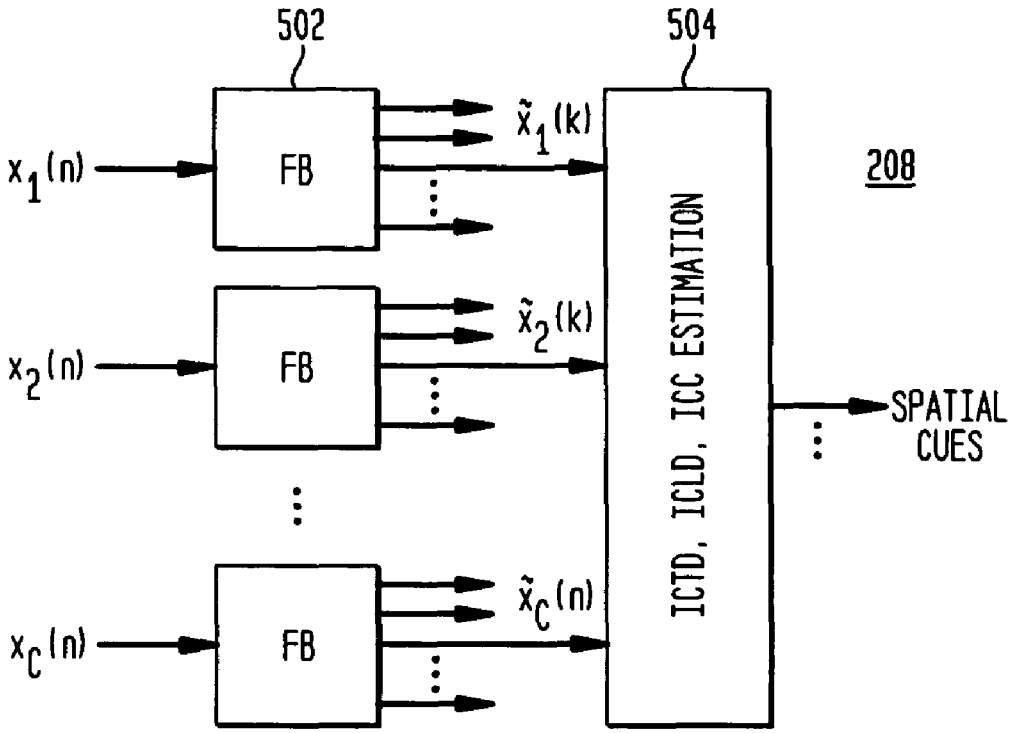
FIG. 5 shows a block diagram of the BCC estimator of FIG. 2, according to one embodiment of the present invention.

FIG. 5 shows a block diagram of BCC estimator 208 of FIG. 2, according to one embodiment of the present invention. BCC estimator 208 comprises filterbanks (FB) 502, which may be the same as filterbanks 302 of FIG. 3, and estimation block 504, which generates ICTD, ICLD, and ICC spatial cues for each different frequency subband generated by filterbanks 502.

Estimation of ICTD, ICLD and ICC for Stereo Signals

The following measures are used for ICTD, ICLD, and ICC for corresponding subband signals $\tilde{x}_1(k)$ and $\tilde{x}_2(k)$ of two (e.g., stereo) audio channels:

ICTD [Samples]:

$$\tau_{12}(k) = \underset{d}{\operatorname{argmax}}\{\Phi_{12}(d, k)\}, \tag{7}$$

with a short-time estimate of the normalized cross-correlation function given by Equation (8) as follows:

$$\Phi_{12}(d, k) = \frac{p_{\tilde{x}_1\tilde{x}_2}(d, k)}{\sqrt{p_{\tilde{x}_1}(k - d_1)\, p_{\tilde{x}_2}(k - d_2)}}, \tag{8}$$

where $$d_1 = \max\{-d, 0\}, \quad d_2 = \max\{d, 0\} \tag{9}$$

and $p_{\tilde{x}_1\tilde{x}_2}(d,k)$ is a short-time estimate of the mean of $\tilde{x}_1(k-d_1)\tilde{x}_2(k-d_2)$.

ICLD [dB]:

$$\Delta L_{12}(k) = 10\log_{10}\left(\frac{p_{\tilde{x}_2}(k)}{p_{\tilde{x}_1}(k)}\right). \tag{10}$$

ICC:

$$c_{12}(k) = \max_d |\Phi_{12}(d,k)|. \tag{11}$$

Note that the absolute value of the normalized cross-correlation is considered and $c_{12}(k)$ has a range of [0,1].

Estimation of ICTD, ICLD, and ICC for Multi-Channel Audio Signals

Figure 6:
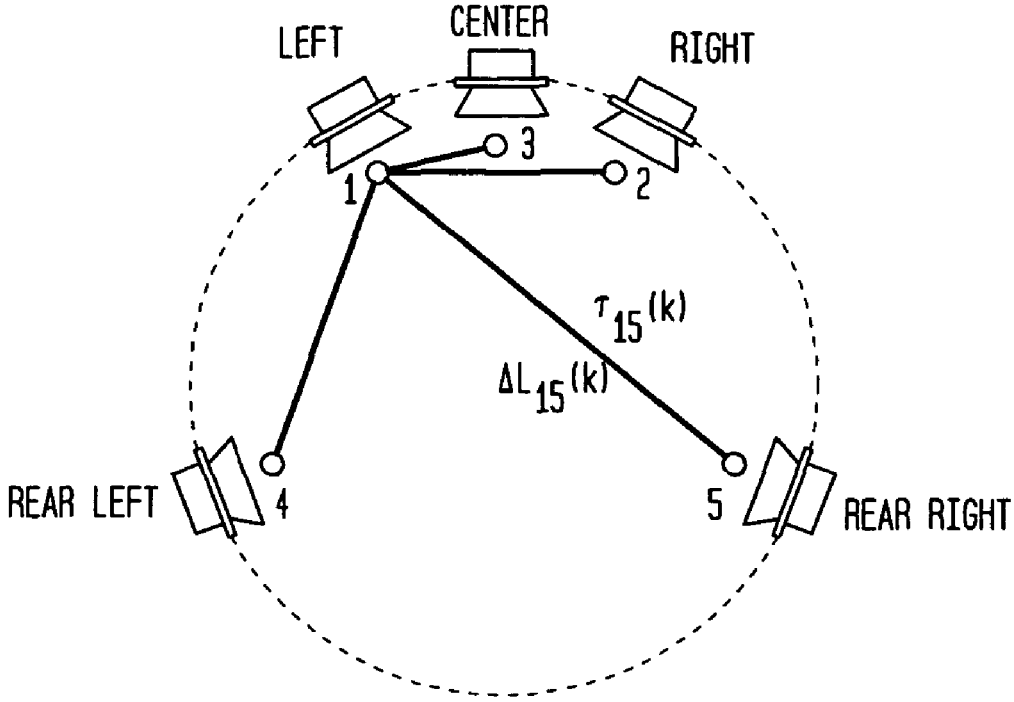
FIG. 6 illustrates the generation of ICTD and ICLD data for five-channel audio.

When there are more than two input channels, it is typically sufficient to define ICTD and ICLD between a reference channel (e.g., channel number 1) and the other channels, as illustrated in FIG. 6 for the case of C=5 channels. where $\tau_{1c}(k)$ and $\Delta L_{1c}(k)$ denote the ICTD and ICLD, respectively, between the reference channel 1 and channel c.

Figure 7A:
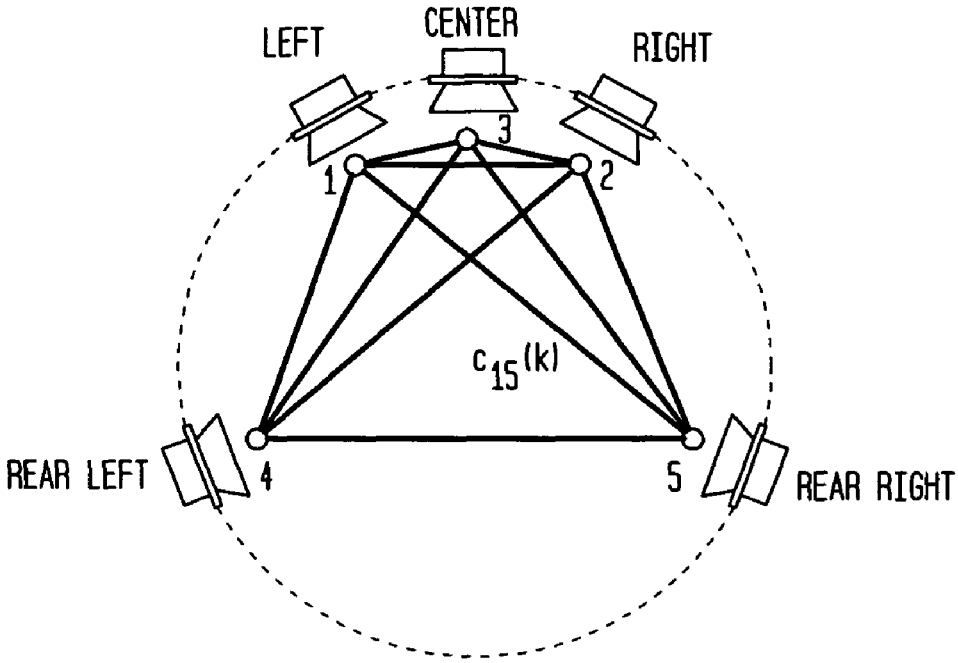
FIG. 7 illustrates the generation of ICC data for five-channel audio.
Figure 7B:
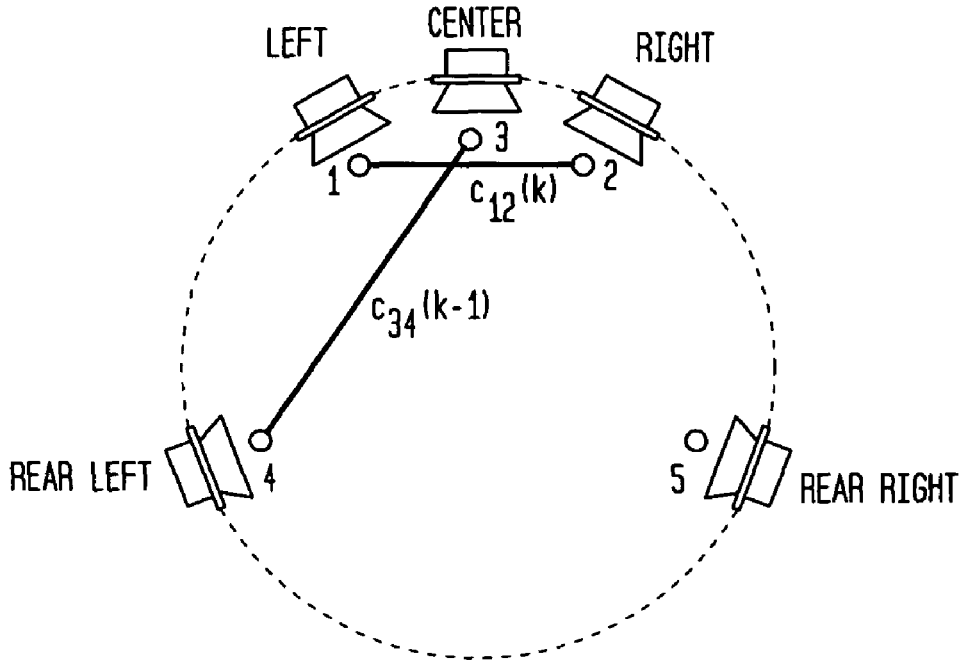

As opposed to ICTD and ICLD, ICC typically has more degrees of freedom. The ICC as defined can have different values between all possible input channel pairs. For C channels, there are C(C−1)/2 possible channel pairs; e.g., for 5 channels there are 10 channel pairs as illustrated in FIG. 7(*a*). However, such a scheme requires that, for each subband at each time index, C(C−1)/2 ICC values are estimated and transmitted, resulting in high computational complexity and high bitrate.

Alternatively, for each subband, ICTD and ICLD determine the direction at which the auditory event of the corresponding signal component in the subband is rendered. One single ICC parameter per subband may then be used to describe the overall coherence between all audio channels. Good results can be obtained by estimating and transmitting ICC cues only between the two channels with most energy in each subband at each time index. This is illustrated in FIG. 7(*b*), where for time instants k−1 and k the channel pairs (3, 4) and (1, 2) are strongest, respectively. A heuristic rule may be used for determining ICC between the other channel pairs.

Synthesis of Spatial Cues

Figure 8:
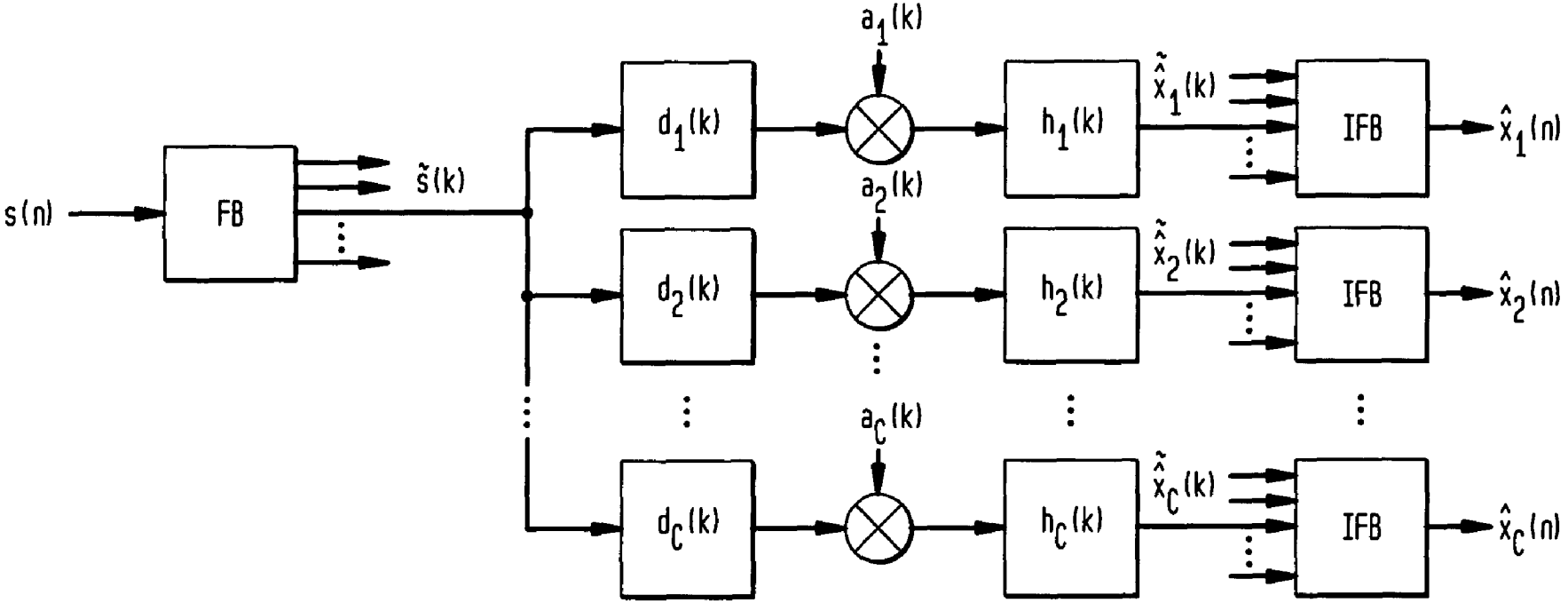
FIG. 8 shows a block diagram of an implementation of the BCC synthesizer of FIG. 4 that can be used in a BCC decoder to generate a stereo or multi-channel audio signal given a single transmitted sum signal s(n) plus the spatial cues.

FIG. 8 shows a block diagram of an implementation of BCC synthesizer 400 of FIG. 4 that can be used in a BCC decoder to generate a stereo or multi-channel audio signal given a single transmitted sum signal s(n) plus the spatial cues. The sum signal s(n) is decomposed into subbands, where $\tilde{s}(k)$ denotes one such subband. For generating the corresponding subbands of each of the output channels, delays $d_c$, scale factors $a_c$, and filters $h_c$ are applied to the corresponding subband of the sum signal. (For simplicity of notation, the time index k is ignored in the delays, scale factors, and filters.) ICTD are synthesized by imposing delays, ICLD by scaling, and ICC by applying de-correlation filters. The processing shown in FIG. 8 is applied independently to each subband.

ICTD Synthesis

The delays $d_c$ are determined from the ICTDs $\tau_{1c}(k)$, according to Equation (12) as follows:

$$d_c = \begin{cases} -\frac{1}{2}(\max_{2\le l\le C}\tau_{1l}(k) + \min_{2\le l\le C}\tau_{1l}(k)), & c = 1 \\ \tau_{1l}(k) + d_1 & 2 \le c \le C. \end{cases} \tag{12}$$

The delay for the reference channel, $d_1$, is computed such that the maximum magnitude of the delays $d_c$ is minimized. The less the subband signals are modified, the less there is a danger for artifacts to occur. If the subband sampling rate does not provide high enough time-resolution for ICTD synthesis, delays can be imposed more precisely by using suitable all-pass filters.

ICLD Synthesis

In order that the output subband signals have desired ICLDs $\Delta L_{12}(k)$ between channel c and the reference channel 1, the gain factors $a_c$ should satisfy Equation (13) as follows:

$$\frac{a_c}{a_1} = 10^{\frac{\Delta L_{1c}(k)}{20}}. \tag{13}$$

Additionally, the output subbands are preferably normalized such that the sum of the power of all output channels is equal to the power of the input sum signal. Since the total original signal power in each subband is preserved in the sum signal, this normalization results in the absolute subband power for each output channel approximating the corresponding power of the original encoder input audio signal. Given these constraints, the scale factors $a_c$ are given by Equation (14) as follows:

$$a_c = \begin{cases} 1\Big/\sqrt{1 + \sum_{i=2}^{C} 10^{\Delta L_{1i}/10}}, & c = 1 \\ 10^{\Delta L_{1c}/20} a_1, & \text{otherwise.} \end{cases} \tag{14}$$

ICC Synthesis

In certain embodiments, the aim of ICC synthesis is to reduce correlation between the subbands after delays and scaling have been applied, without affecting ICTD and ICLD. This can be achieved by designing the filters $h_c$ in FIG. 8 such that ICTD and ICLD are effectively varied as a function of frequency such that the average variation is zero in each subband (auditory critical band).

Figure 9:
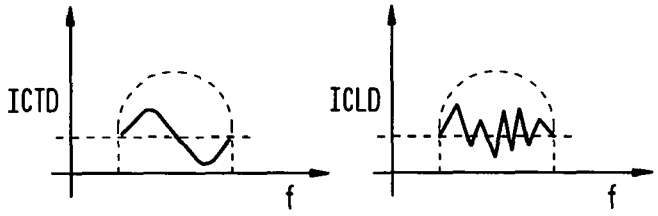
FIG. 9 illustrates how ICTD and ICLD are varied within a subband as a function of frequency.

FIG. 9 illustrates how ICTD and ICLD are varied within a subband as a function of frequency. The amplitude of ICTD and ICLD variation determines the degree of de-correlation and is controlled as a function of ICC. Note that ICTD are varied smoothly (as in FIG. 9(*a*)), while ICLD are varied randomly (as in FIG. 9(*b*)). One could vary ICLD as smoothly as ICTD, but this would result in more coloration of the resulting audio signals.

Another method for synthesizing ICC, particularly suitable for multi-channel ICC synthesis, is described in more detail in C. Faller, "Parametric multi-channel audio coding: Synthesis of coherence cues," *IEEE Trans. on Speech and Audio Proc.*, 2003, the teachings of which are incorporated herein by reference. As a function of time and frequency, specific amounts of artificial late reverberation are added to each of the output channels for achieving a desired ICC. Additionally, spectral modification can be applied such that the spectral envelope of the resulting signal approaches the spectral envelope of the original audio signal.

Other related and unrelated ICC synthesis techniques for stereo signals (or audio channel pairs) have been presented in E. Schuijers, W. Oomen, B. den Brinker, and J. Breebaart, "Advances in parametric coding for high-quality audio," in *Preprint* 114$^{th}$ *Conv. Aud. Eng. Soc.,* March 2003, and J. Engdegard, H. Purnhagen, J. Roden, and L. Liljeryd, "Synthetic ambience in parametric stereo coding," in *Preprint* 117$^{th}$ *Conv. Aud. Eng. Soc.,* May 2004, the teachings of both of which are incorporated here by reference.

C-to-E BCC

As described previously, BCC can be implemented with more than one transmission channel. A variation of BCC has been described which represents C audio channels not as one single (transmitted) channel, but as E channels, denoted C-to-E BCC. There are (at least) two motivations for C-to-E BCC:

- BCC with one transmission channel provides a backwards compatible path for upgrading existing mono systems for stereo or multi-channel audio playback. The upgraded systems transmit the BCC downmixed sum signal through the existing mono infrastructure, while additionally transmitting the BCC side information. C-to-E BCC is applicable to E-channel backwards compatible coding of C-channel audio.
- C-to-E BCC introduces scalability in terms of different degrees of reduction of the number of transmitted channels. It is expected that the more audio channels that are transmitted, the better the audio quality will be.

Signal processing details for C-to-E BCC, such as how to define the ICTD, ICLD, and ICC cues, are described in U.S. application Ser. No. 10/762,100, filed on Jan. 20, 2004 (Faller 13-1).

BCC with Cues Based on Transmitted Channels

As described above, in a conventional C-to-E BCC scheme, the encoder derives BCC cues (e.g., ICTD, ICLD, and/or ICC cues) from C original channels. In addition, the encoder downmixes the C original channels to generate E downmixed channels that are transmitted along with the derived BCC cues to a decoder, which uses the transmitted (i.e., side information) BCC cues to generate C synthesized channels from the E transmitted channels.

There are some applications, however, where it may be desirable to implement a BCC scheme with cues derived from the E transmitted channels. In one exemplary application, an encoder downmixes C original channels to generate E downmixed channels, but does not transmit any BCC cues as side information to the decoder. Instead, the decoder (or perhaps a pre-processor upstream of the decoder) derives BCC cues from the transmitted channels and uses those derived BCC codes to generate C synthesized channels from the E transmitted channels. Advantageously, the amount of transmitted data in this situation is less than that of a conventional BCC scheme that transmits BCC cues as side information.

In another exemplary application, there is no downmixing of C original channels to generate E downmixed channels at an encoder. In this application, the only original channels may be the E transmitted channels. As in the previous example, the decoder (or pre-processor) derives BCC cues from the transmitted channels and uses those derived BCC codes to generate C synthesized channels from the E transmitted channels. In theory, this application can be used to convert existing stereo signals into multi-channel (e.g., surround) signals.

Note that, in certain embodiments of the present invention, BCC codes could be derived at an encoder and transmitted as side information along with the transmitted channels to a decoder, where those BCC codes are derived from the transmitted (e.g., downmixed) channels, rather from the original (e.g., pre-downmixed) channels.

Figure 10:
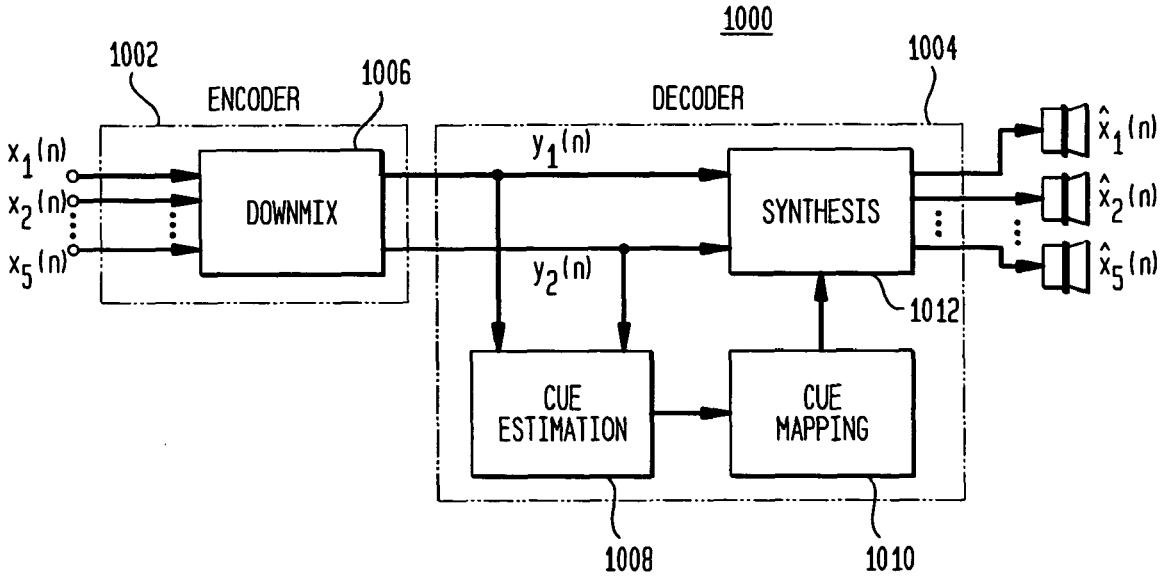
FIG. 10 shows a block diagram of a 5-to-2 BCC audio processing system, according to one embodiment of the present invention.

FIG. 10 shows a block diagram of a 5-to-2 BCC audio processing system 1000, according to one embodiment of the present invention, where no BCC codes are transmitted from the encoder to the decoder as side information along with the transmitted channels. 5-to-2 BCC system 1000 comprises an encoder 1002 and a decoder 1004. Encoder 1002 includes downmixer 1006, while decoder 1004 includes cue estimator 1008, cue mapper 1010, and synthesizer 1012. Although this discussion relates to 5-to-2 BCC schemes, the present invention can be applied generally to C-to-E BCC schemes, where C>E>1.

In encoder 1002, downmixer 1006 downmixes five original surround channels $x_i(n)$ to generate two transmitted stereo channels $y_i(n)$. In decoder 1004, cue estimator 1008 generates estimated inter-channel cues from the transmitted stereo signal, cue mapper 1010 maps those stereo cues to surround cues, and synthesizer 1012 applies those surround cues to the two transmitted stereo channels to generate five synthesized surround channels $\hat{x}_i(n)$.

As indicated in FIG. 10, unlike conventional BCC schemes, such as that illustrated in FIG. 2, encoder 1002 of system 1000 does not generate BCC cues from the original surround channels. Rather, cues are derived from the transmitted, downmixed stereo channels at decoder 1004 for use in generating the synthesized surround channels. As such, in system 1000, no BCC cues are transmitted as side information along with the downmixed stereo channels.

According to one possible implementation, encoder 1002 compresses a 5-channel 360° surround sound image to a 2-channel 60° stereo signal, where the stereo signal is generated such that auditory events in the 5-channel surround sound image appear at distinct locations in the stereo sound image. At decoder 1004, BCC cues for each auditory event in the stereo image are chosen such that the auditory event can be mapped in the synthesized surround image back to its approximate location in the original surround image.

Encoder Processing

Figure 11A:
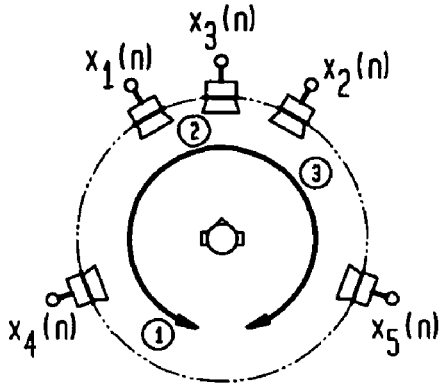
FIG. 11A illustrates one possible 5-channel surround configuration.

FIG. 11A illustrates one possible 5-channel surround configuration, in which the left loudspeaker (#1) is located 30° to the left of the center loudspeaker (#3), the right loudspeaker (#2) is located 30° to the right of the center loudspeaker, the left rear loudspeaker (#4) is located 110° to the left of the center loudspeaker, and the right rear loudspeaker (#5) is located 110° to the right of the center loudspeaker.

Figure 11B:
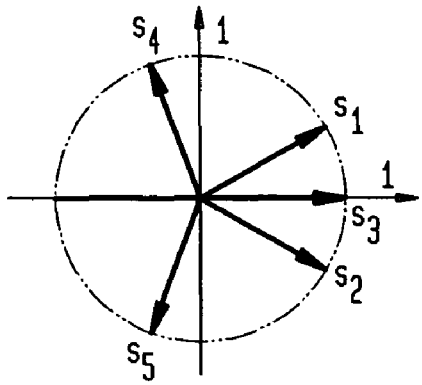
FIG. 11B graphically represents the orientations of the five loudspeakers of FIG. 11A.

FIG. 11B graphically represents the orientations of the five loudspeakers of FIG. 11A as unit vectors $s_i$, where the X-axis represents the orientation of the center loudspeaker and the Y-axis represents an orientation 90° to the left of the center loudspeaker.

Figure 11C:
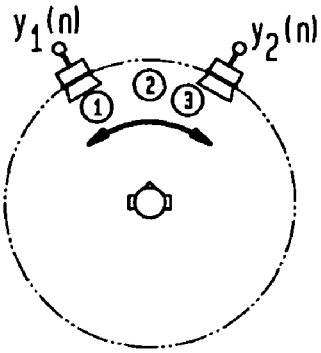
FIG. 11C illustrates one possible stereo configuration to which the 5-channel surround sound of FIG. 11A is mapped by the encoder of FIG. 10.

FIG. 11C illustrates one possible stereo configuration to which the 5-channel surround sound of FIG. 11A is mapped by encoder 1002 of FIG. 10, in which the left and right loudspeakers are separated by about 60°.

Figure 12:
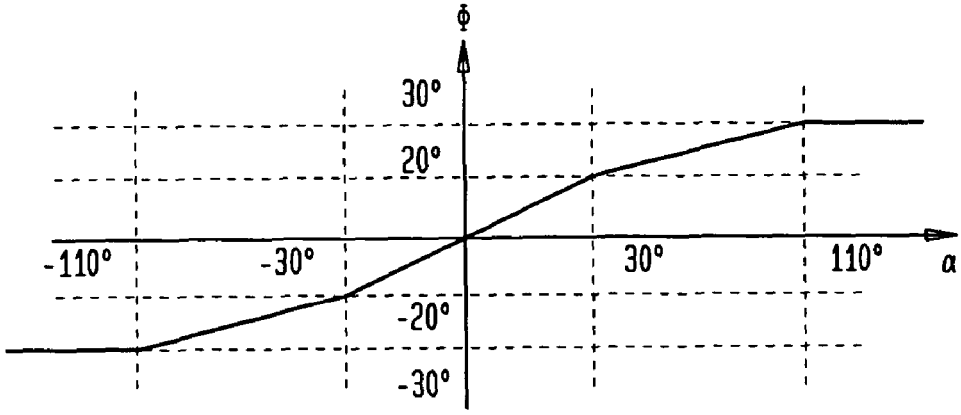
FIG. 12 graphically represents one possible mapping that can be used to downmix the five surround channels of FIG. 11A to the two stereo channels of FIG. 11C.

FIG. 12 graphically represents one possible mapping that can be used to downmix the five surround channels $x_i(n)$ of FIG. 11A to the two stereo channels $y_i(n)$ of FIG. 11C. According to this mapping, auditory events located between −180 and −30 degrees are mapped (angle compressed) to a range of −30 to −20 degrees. Auditory events located between −30 and 0 degrees are mapped (angle compressed) to −20 and 0. Similarly, for positive angles, auditory events located between 30 and 180 degrees are mapped (angle compressed) to a range of 20 to 30 degrees. Auditory events located between 0 and 30 degrees are mapped (angle compressed) to 0 and 20 degrees. Effectively, this compresses the original ±30 degree front image to ±20 degrees, and appends the side and rear parts of the surround image on the sides of the compressed front image (to the ranges −30 to −20 and 20 to 30 degrees). Other transformations, including those having different numbers of regions and/or those having one or more non-linear regions, are possible.

The mapping of FIG. 12 can be represented according to the matrix-based transformation of Equation (15) as follows:

$$\begin{bmatrix} y_1(n) \\ y_2(n) \end{bmatrix} = \begin{bmatrix} 0.9 & 0.44 & 0.7 & 1.0 & 0.0 \\ 0.44 & 0.9 & 0.7 & 0.0 & 1.0 \end{bmatrix} \begin{bmatrix} x_1(n) \\ x_2(n) \\ x_3(n) \\ x_4(n) \\ x_5(n) \end{bmatrix}, \tag{15}$$

where, for example, the factors 0.9 and 0.44 in the first two columns of the (2×5) downmixing matrix correspond to the compression from ±30° to ±20°, while the factors 1.0 and 0.0 in the last two columns correspond to the compression from ±110° to ±30°. Note also that, in order to preserve overall signal power level during downmixing, the sum of the squares of the entries in each column of the downmixing matrix sum to 1.

According to this transformation, the left and right channels (#1 and #2) are mixed to the transmitted stereo signal with crosstalk. The center channel (#3) is mixed to the left and right with the same strength. As such, the front center of the surround image remains in the front center of the stereo image. The left channel (#4) is mixed to only the left stereo channel, and the right channel (#5) is mixed to only the right stereo channel. Since no crosstalk is used here, the left and right rear channels are mapped to the far left and right sides, respectively, of the stereo image.

The downmixing operation represented in Equation (15) is implemented in the time domain, which implies that the same downmixing matrix is used for the full frequency band. In alternative implementations, downmixing can be implemented in the frequency domain, where, in theory, a different downmixing matrix may be used for each different frequency subband.

Figure 13:
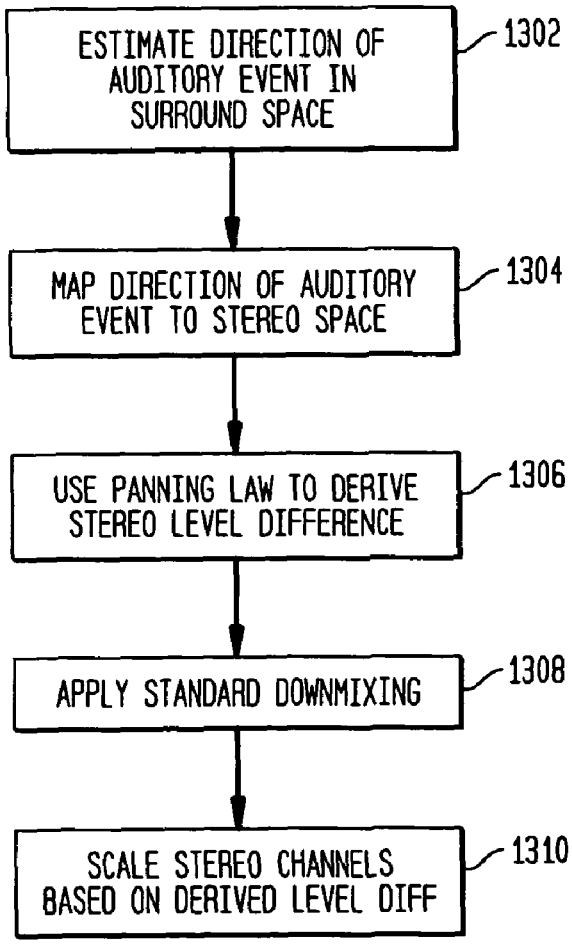
FIG. 13 shows a flow diagram of the processing according to one possible adaptive downmixing operation of the present invention.

Rather than applying a fixed downmixing matrix, as in Equation (15), in an alternative embodiment, downmixer 1006 of FIG. 10 could implement adaptive downmixing. FIG. 13 shows a flow diagram of the processing implemented at each time period (e.g., 20 msec), according to one possible adaptive downmixing operation of the present invention. Depending on the particular implementation, the processing of FIG. 13 can be applied to the entire spectrum or independently to individual BCC subbands.

In particular, the direction of the corresponding auditory event in the surround image is estimated (step 1302 of FIG. 13) according to Equation (16) as follows:

$$\alpha = \angle \sum_{i=1}^{5} p_i(k) s_i, \tag{16}$$

where $\alpha$ is the estimated angle of the auditory event with respect to the X-axis of FIG. 11B, $p_i(k)$ is the power of surround channel i at time index k, and $s_i$ is the unit vector $(\cos\theta_i, \sin\theta_i)^T$ for surround channel i, where $\theta_i$ is the surround loudspeaker angle with respect to the X-axis in FIG. 11B.

The angle $\alpha$ of the auditory event in surround space is then mapped to an angle $\phi$ in stereo space, e.g., using the transformation of FIG. 12 (step 1304).

An amplitude-panning law (or other possible frequency-dependent relation) is then applied to derive a desired level difference between the two stereo channels in the stereo space (step 1306). When amplitude panning is applied, the perceived direction of an auditory event may be estimated from the stereophonic law of sines given by Equation (17) as follows:

$$\frac{\sin\phi}{\sin\phi_0} = \frac{a_1 - a_2}{a_1 + a_2}, \tag{17}$$

where $0° \leqq \phi_0 \leqq 90°$ is the magnitude of the angle between the X-axis of FIG. 11B and each stereo loudspeaker, $\phi$ is the corresponding angle of the auditory event, and $a_1$ and $a_2$ are scale factors that are related to the level-difference cue ICLD, according to Equation (18) as follows:

$$\Delta L_{12}(k) = 20 \log_{10}(a_2/a_1). \tag{18}$$

Figure 14:
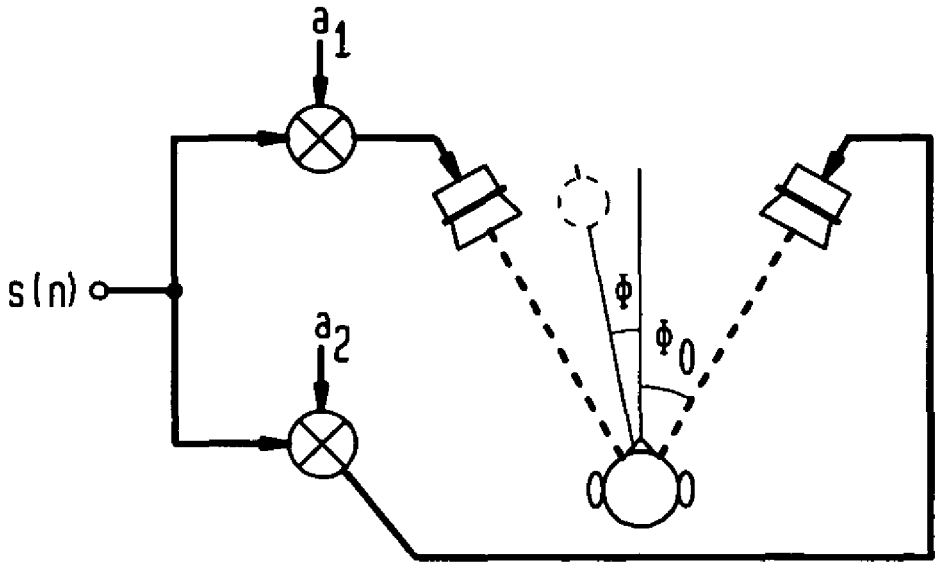
FIG. 14 illustrates the angles and the scale factors used in the decoder of FIG. 10.
Figure 15:
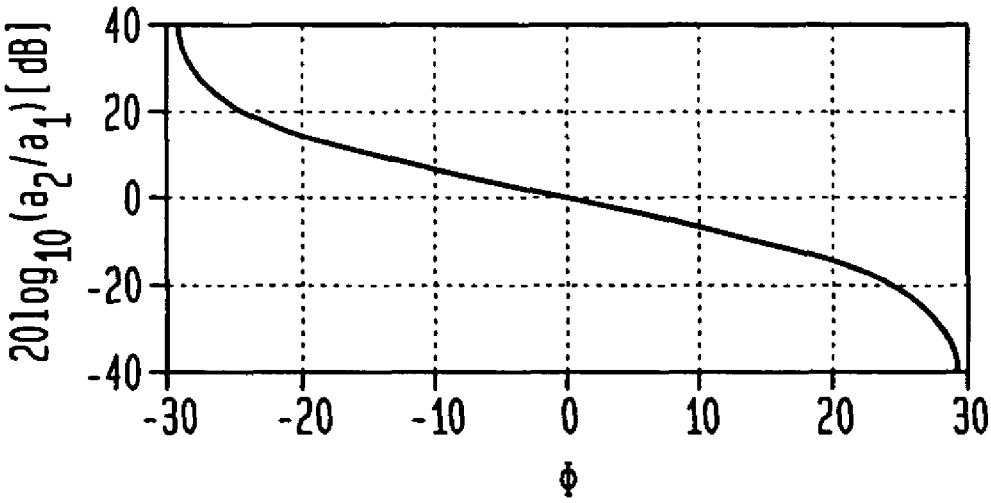
FIG. 15 graphically represents the relationship between ICLD and the stereo event angle, according to the stereophonic law of sines.

FIG. 14 illustrates the angles $\phi_0$ and $\phi$ and the scale factors $a_1$ and $a_2$, where s(n) represents a mono signal that appears at angle $\phi$ when amplitude panning is applied based on the scale factors $a_1$ and $a_2$. FIG. 15 graphically represents the relationship between ICLD and the stereo event angle $\phi$ according to the stereophonic law of sines of Equation (17) for a standard stereo configuration with $\phi_0$=30°.

The five surround channels are then downmixed using conventional downmixing (step 1308), according to Equation (19) as follows:

$$\begin{bmatrix} y_1(n) \\ y_2(n) \end{bmatrix} = \begin{bmatrix} 1.0 & 0.0 & 0.7 & 1.0 & 0.0 \\ 0.0 & 1.0 & 0.7 & 0.0 & 1.0 \end{bmatrix} \begin{bmatrix} x_1(n) \\ x_2(n) \\ x_3(n) \\ x_4(n) \\ x_5(n) \end{bmatrix}. \tag{19}$$

According to this standard downmixing, (i) the left and left rear surround channels are mapped to the left stereo channel, (ii) the right and right rear surround channels are mapped to the right stereo channel, and (iii) center surround channel is divided evenly between the left and right stereo channels, all without any crosstalk between the left and right sides of the surround image.

The left and right stereo channels are then scaled using the scale factors $a_1$ and $a_2$ respectively, corresponding to the level difference derived from amplitude panning (step 1310) such that Equation (20) is satisfied as follows:

$$\frac{p_2}{p_1} = \frac{a_2^2}{a_1^2}, \tag{20}$$

where $p_1$ and $p_2$ are the powers of the left and right downmixed stereo channels, respectively, after scaling and where the scale factors are normalized (i.e., $a_1^2+a_2^2=1$) to ensure that the total stereo power is the same before and after scaling.

According to another embodiment, the downmixing transformation is generated based on principles of conventional matrixing algorithms, such as those described in J. Hall, "Surround sound past, present, and future," Tech. Rep., Dolby Laboratories, 1999, www.dolby.com/tech/, and R. Dressler, "Dolby Surround Prologic II Decoder—Principles of operation," Tech. Rep., Dolby Laboratories, 2000, www.dolby.com/tech/, the teachings of both of which are incorporated herein by reference. A matrixing algorithm applies a downmixing matrix to reduce the number of channels, e.g., five input channels to two stereo (i.e., left and right) output channels. Usually the rear input channels are mixed out of phase with the left and right input channels, such that, to some extent, they can be recovered at a matrixing decoder (by assuming that rear channels are out of phase in the stereo signal). For example, one possible, time-domain downmixing operation is defined by Equation (21) as follows:

$$\begin{bmatrix} y_1(n) \\ y_2(n) \end{bmatrix} = \begin{bmatrix} 1.0 & 0.0 & 0.7 & 0.8 & -0.6 \\ 0.0 & 1.0 & 0.7 & -0.6 & 0.8 \end{bmatrix} \begin{bmatrix} x_1(n) \\ x_2(n) \\ x_3(n) \\ x_4(n) \\ x_5(n) \end{bmatrix}, \tag{21}$$

where the negative factors in the downmixing matrix correspond to channels that are downmixed out of phase. Note that here, for the left and right channels (#1 and #2), no crosstalk is introduced. As such, the full front surround image width is maintained without any image compression. Here, too, downmixing can alternatively be implemented in the frequency domain with different downmixing matrices used for different frequency subbands. Moreover, downmixing can be fixed (as in Equation (15)) or applied as part of an adaptive algorithm (as in Equation (19) and FIG. 13).

In general, whatever downmixing technique is used to generate the two stereo channels from the five surround channels, the technique is preferably designed to enable a decoder, such as decoder 1004 of FIG. 10, to map the resulting, transmitted stereo image to a synthesized surround image that, for example, approximates the original, 5-channel surround image.

Decoder Processing

Referring again to FIG. 10, depending on the particular implementation, the estimated inter-channel cues generated by cue estimator 1008 of decoder 1004 for the transmitted stereo signal can include ICLD, ICTD, and/or ICC data. Estimated ICLD, ICTD, and ICC cues may be generated by applying Equations (7)-(11) to corresponding subband signals $\tilde{y}_1(k)$ and $\tilde{y}_2(k)$ of the two transmitted stereo channels.

Figure 16:
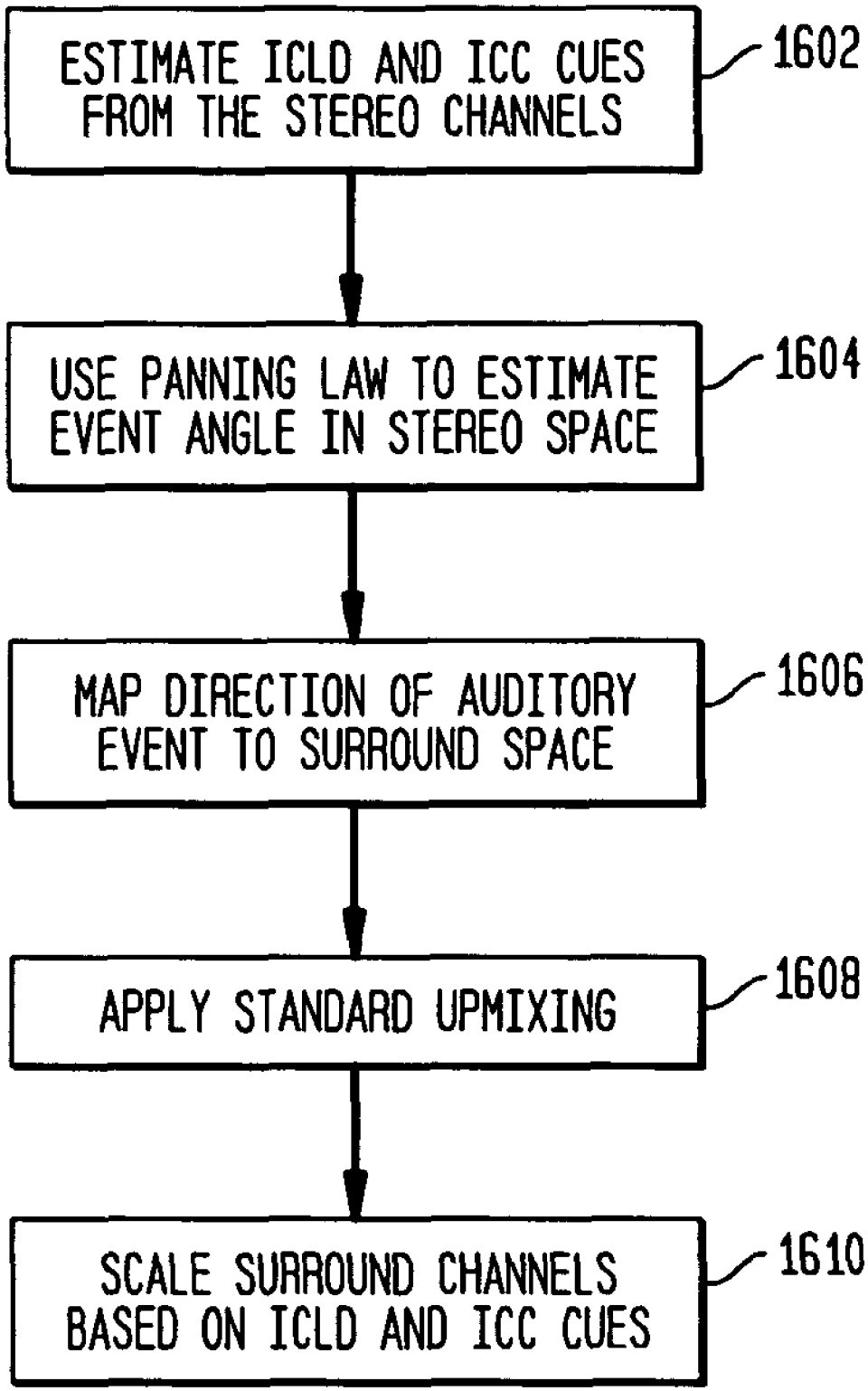
FIG. 16 shows a flow diagram of the processing according to one possible decoding operation of the present invention.

FIG. 16 shows a flow diagram of the processing implemented at each time period (e.g., 20 msec), according to one possible decoding operation of the present invention. This exemplary procedure uses ICLD and ICC cues, but not ICTD cues. At each time k and in each BCC subband, the following processing is carried out independently.

Cue estimator 1008 of FIG. 10 derives estimated ICLD and ICC values using Equations (10) and (11) (step 1602 of FIG. 16) and then estimates the angle $\phi$ of the auditory event in the stereo image using Equation (18) based on the amplitude-panning law of Equation (17) (step 1604).

Cue mapper 1010 of FIG. 10 maps the stereo event angle $\phi$ to a corresponding auditory event angle $\alpha$ in surround space, for example, using the transformation of FIG. 12 (step 1606).

Synthesizer 1012 of FIG. 10 generates five upmixed channels from the transmitted stereo channels (step 1608). The upmixing matrix applied by the upmixer of synthesizer 1012, analogous to upmixer 404 of FIG. 4, will depend on the downmixing matrix applied by downmixer 1006 of FIG. 10. For example, the upmixing operation corresponding to the downmixing operation of Equation (19) is given by Equation (22) as follows:

$$\begin{bmatrix} \tilde{s}_1(k) \\ \tilde{s}_2(k) \\ \tilde{s}_3(k) \\ \tilde{s}_4(k) \\ \tilde{s}_5(k) \end{bmatrix} = \begin{bmatrix} 1 & 0 \\ 0 & 1 \\ 0.7 & 0.7 \\ 1 & 0 \\ 0 & 1 \end{bmatrix} \begin{bmatrix} \tilde{y}_1(k) \\ \tilde{y}_2(k) \end{bmatrix}, \tag{22}$$

where the left stereo channel is copied to both the left and left rear surround channels, the right stereo channel is copied to both the right and right rear surround channels, and the left and right stereo channels 20 are averaged for the center surround channel. Similarly, the upmixing operation corresponding to the downmixing operation of Equation (21) is given by Equation (23) as follows:

$$\begin{bmatrix} \tilde{s}_1(k) \\ \tilde{s}_2(k) \\ \tilde{s}_3(k) \\ \tilde{s}_4(k) \\ \tilde{s}_5(k) \end{bmatrix} = \begin{bmatrix} 1 & 0 \\ 0 & 1 \\ 0.7 & 0.7 \\ 0.6 & -0.8 \\ -0.8 & 0.6 \end{bmatrix} \begin{bmatrix} \tilde{y}_1(k) \\ \tilde{y}_2(k) \end{bmatrix}, \tag{23}$$

where, as in Equation (22), the left stereo channel is copied to the left surround channel, the right stereo channel is copied to the right surround channel, and the left and right stereo channels are averaged for the center surround channel. In this case, however, the left and right stereo channels are mixed using inverse matrixing to form the base channels for the left rear and right rear surround channels.

At step 1610, synthesizer 1012 scales the upmixed channels based on the ICLD and ICC cues estimated in step 1602. In particular, synthesizer 1012 applies the estimated ICLD and ICC values to generate the synthesized, 5-channel surround signal in a manner analogous to the BCC synthesis processing shown in FIG. 4 with all ICTD values $d_i(k)$ set to 0 (although, in alternative implementations that also use ICTD values, at least some of the $d_i(k)$ values will be nonzero). For example, in one possible implementation, this scaling is implemented as follows:

(1) Select the loudspeaker pair m, n that immediately surrounds the surround event angle $\alpha$.

(2) Apply a panning law, such as that given by Equation (17), to compute the ratio of power of direct (i.e., correlated) sound given to loudspeakers m and n according to Equation (23) as follows:

$$\frac{p_m}{p_n} = \frac{a_m^2}{a_n^2}, \tag{23}$$

where $p_m$ is the power of direct sound given to loudspeaker m, and $p_n$ is the power of direct sound given to loudspeaker n.

(3) Based on the ICC cue $c_{12}(k)$ estimated from the transmitted stereo signal, apply de-correlated (e.g., late reverberation) sound of power $p_a$ to all loudspeakers, where the de-correlated signal power $p_a$ is related to the ICC according to Equation (24) as follows:

$$c_{12}(k) = \frac{p_m + p_n}{p_m + p_n + Cp_a}, \tag{24}$$

where C is the number of channels in the surround signal.

The de-correlation block of synthesizer 1012, analogous to block 410 of FIG. 4, generates output channel subbands that contain approximately the amounts of direct and de-correlated sound computed using Equations (23) and (24).

If the transmitted stereo signal has been generated according to Equation (21), then the following considerations may be applied:

If $\min_d(\Phi_{12}(d, k)) \approx -1$, then there are out-of-phase components, likely due to relatively large power levels in the left rear and/or right rear surround channels (due to the choice of the downmixing matrix).

If $\min_d(\Phi_{12}(d,k)) \approx -1$ and ICLD>0, then the BCC subband belongs to the right rear surround channel and most of the energy should be rendered to the right rear loudspeaker.

If $\min_d(\Phi_{12}(d, k)) \approx -1$ and ICLD<0, then the BCC subband belongs to the left rear surround channel and most of the energy should be rendered to the left rear loudspeaker.

Further Alternative Embodiments

Although the present invention has been described in the context of implementations where no BCC cues are transmitted for any subbands, in alternative implementations, cues could be transmitted for some subbands, while other subbands have no transmitted cues. In these implementations, the decoder would derive cues from one or more of the subbands that were transmitted without cues.

As mentioned previously, although the present invention has been described in the context of a 5-to-2 BCC scheme, in general, the invention can be implemented for any C-to-E BCC scheme, where C>E>1, by applying the same principles as in the 5-to-2 BCC scheme described previously. A BCC scheme according to certain embodiments of the present invention involves the estimation of inter-channel cues between transmitted channels for use in computing multi-channel cues for generating a multi-channel signal using BCC-like synthesis. Although, in the examples described previously, the estimated cues are derived from the transmitted channels at the decoder, in theory, the estimated cues or even the multi-channel cues could be generated at an encoder or other processor upstream of the decoder and then transmitted to the decoder for use in generating the synthesized multi-channel signal.

Although the present invention has been described in the context of BCC coding schemes involving ICTD, ICLD, and/or ICC codes, the present invention can also be implemented in the context of other BCC coding schemes involving one or more additional or alternative types of codes.

Although the present invention has been described in the context of BCC coding schemes, the present invention can also be implemented in the context of other audio processing systems in which audio signals are de-correlated or other audio processing that needs to de-correlate signals.

Although the present invention has been described in the context of implementations in which the encoder receives input audio signal in the time domain and generates transmitted audio signals in the time domain and the decoder receives the transmitted audio signals in the time domain and generates playback audio signals in the time domain, the present invention is not so limited. For example, in other implementations, any one or more of the input, transmitted, and playback audio signals could be represented in a frequency domain.

BCC encoders and/or decoders may be used in conjunction with or incorporated into a variety of different applications or systems, including systems for television or electronic music distribution, movie theaters, broadcasting, streaming, and/or reception. These include systems for encoding/decoding transmissions via, for example, terrestrial, satellite, cable, internet, intranets, or physical media (e.g., compact discs, digital versatile discs, semiconductor chips, hard drives, memory cards, and the like). BCC encoders and/or decoders may also be employed in games and game systems, including, for example, interactive software products intended to interact with a user for entertainment (action, role play, strategy, adventure, simulations, racing, sports, arcade, card, and board games) and/or education that may be published for multiple machines, platforms, or media. Further, BCC encoders and/or decoders may be incorporated in audio recorders/players or CD-ROM/DVD systems. BCC encoders and/or decoders may also be incorporated into PC software applications that incorporate digital decoding (e.g., player, decoder) and software applications incorporating digital encoding capabilities (e.g., encoder, ripper, recoder, and jukebox).

The present invention may be implemented as circuit-based processes, including possible implementation as a single integrated circuit (such as an ASIC or an FPGA), a multi-chip module, a single card, or a multi-card circuit pack. As would be apparent to one skilled in the art, various functions of circuit elements may also be implemented as processing steps in a software program. Such software may be employed in, for example, a digital signal processor, microcontroller, or general-purpose computer.

The present invention can be embodied in the form of methods and apparatuses for practicing those methods. The present invention can also be embodied in the form of program code embodied in tangible media, such as floppy diskettes, CD-ROMs, hard drives, or any other machine-readable storage medium, wherein, when the program code is loaded into and executed by a machine, such as a computer, the machine becomes an apparatus for practicing the invention. The present invention can also be embodied in the form of program code, for example, whether stored in a storage medium, loaded into and/or executed by a machine, or transmitted over some transmission medium or carrier, such as over electrical wiring or cabling, through fiber optics, or via electromagnetic radiation, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits.

The present invention can also be embodied in the form of a bitstream or other sequence of signal values electrically or optically transmitted through a medium, stored magnetic-field variations in a magnetic recording medium, etc., generated using a method and/or an apparatus of the present invention.

It will be further understood that various changes in the details, materials, and arrangements of the parts which have been described and illustrated in order to explain the nature of this invention may be made by those skilled in the art without departing from the scope of the invention as expressed in the following claims.

Although the steps in the following method claims, if any, are recited in a particular sequence with corresponding labeling, unless the claim recitations otherwise imply a particular sequence for implementing some or all of those steps, those steps are not necessarily intended to be limited to being implemented in that particular sequence.

I claim:

1. A receiver-implemented method for synthesizing C playback audio channels from E transmitted audio channels, where C>E>1, the method comprising:

deriving one or more cues from the E transmitted channels, wherein the one or more derived cues comprise a coherence cue, wherein the coherence cue is derived from two of the transmitted channels by:

generating power estimates for each of the two transmitted channels;

generating at least one cross-correlation estimate for the two transmitted channels; and generating the coherence cue based on the power estimates and the cross-correlation estimate;

upmixing one or more of the E transmitted channels to generate one or more upmixed channels; and synthesizing one or more of the C playback channels from the one or more upmixed channels based on the one or more derived cues, including the coherence cue.

2. The invention of claim 1, wherein the method is independently implemented for different subbands.

3. The invention of claim 2, wherein, for each different subband, the method is independently implemented for different times.

4. The invention of claim 1, wherein:

the one or more derived cues in a transmitted-channel domain are mapped to one or more mapped cues in a playback-channel domain; and the one or more playback channels are synthesized by applying the one or more mapped cues to the one or more upmixed channels.

5. The invention of claim 3, wherein:

the C playback channels are surround sound channels;

the one or more mapped cues comprise:

two or more level-difference cues, each level-difference cue corresponding to a different pair of surround sound channels; and two or more coherence cues, each coherence cue corresponding to a different pair of surround sound channels.

6. The invention of claim 1, wherein the deriving comprises applying a panning law to a pair of transmitted channels to derive a cue.

7. The invention of claim 1, wherein the method comprises:

applying a panning law to determine information corresponding to an auditory event in a transmitted-channel domain;

mapping the information corresponding to the auditory event in the transmitted-channel domain to information corresponding to an auditory event in a playback-channel domain;

applying a panning law in the playback-channel domain to determine relative power levels for at least two playback channels; and scaling the at least two playback channels based on the determined relative power levels.

8. The invention of claim 7, wherein the method further comprises generating a de-correlated power level for one or more playback channels based on the coherence cue.

9. The invention of claim 1, wherein:

the E transmitted channels were generated by applying a downmixing operation to C input audio channels; and the upmixing comprises applying an upmixing operation to the E transmitted channels to generate C upmixed channels, wherein the upmixing operation is selected based on the downmixing operation.

10. The invention of claim 9, wherein at least one part of the upmixing operation is based on matrixing.

11. The invention of claim 9, wherein the upmixing operation involves crosstalk between at least one pair of transmitted channels to generate one or more non-center upmixed channels.

12. The invention of claim 1, wherein the E transmitted channels are received without any cues as side information.

13. The invention of claim 1, wherein at least one part of the upmixing is based on matrixing.

14. The invention of claim 1, further comprising extracting one or more cues from side information transmitted with the E transmitted channels, wherein the one or more synthesized playback channels are synthesized from the one or more upmixed channels based on the one or more derived cues and the one or more extracted cues.

15. The invention of claim 1, wherein E=2.

16. The invention of claim 1, wherein the E transmitted audio channels correspond to a downmixed surround sound signal generated by applying a downmixing matrix to a surround sound signal.

17. The invention of claim 1, wherein the coherence cue is a measure of similarity between at least two of the E transmitted channels.

18. The invention of claim 1, wherein the one or more derived cues comprise a level-difference cue.

19. An apparatus for synthesizing C playback audio channels from E transmitted audio channels, where C>E>1, the apparatus comprising:

means for deriving one or more cues from the E transmitted channels, wherein the one or more derived cues comprise a coherence cue, wherein the coherence cue is derived from two of the transmitted channels by:

generating power estimates for each of the two transmitted channels;

generating at least one cross-correlation estimate for the two transmitted channels; and generating the coherence cue based on the power estimates and the cross-correlation estimate;

means for upmixing one or more of the E transmitted channels to generate one or more upmixed channels; and means for synthesizing one or more of the C playback channels from the one or more upmixed channels based on the one or more derived cues, including the coherence cue.

20. An apparatus for synthesizing C playback audio Channels from E transmitted audio channels, where C>E>I, the apparatus comprising:

a cue estimator apparatus adapted to derive one or more cues from the E transmitted channels, wherein the one or more derived cues comprise a coherence cue, wherein the coherence cue is derived from two of the transmitted channels by:

generating power estimates for each of the two transmitted channels;

generating at least one cross-correlation estimate for the two transmitted channels; and generating the coherence cue based on the power estimates and the cross-correlation estimate; and a synthesizer apparatus adapted to:

upmix one or more of the E transmitted channels to generate one or more upmixed channels; and synthesize one or more of the C playback channels from the one or more upmixed channels based on the one or more derived cues, including the coherence cue.

21. The invention of claim 20, further comprising a cue mapper adapted to map the one or more derived cues in a transmitted-channel domain to one or more mapped cues in a playback-channel domain, wherein the synthesizer is adapted to synthesize the one or more playback channels by applying the one or more mapped cues to the one or more upmixed channels.

22. The invention of claim 21, wherein:

the C playback channels are surround sound channels;

the one or more mapped cues comprise:

two or more level-difference cues, each level-difference cue corresponding to a different pair of surround sound channels; and two or more coherence cues, each coherence cue corresponding to different a pair of surround sound channels.

23. The invention of claim 20, further comprising a cue mapper, wherein:

the cue estimator is adapted to apply a panning law to determine information corresponding to an auditory event direction in a transmitted-channel domain;

the cue mapper is adapted to map the information corresponding to the auditory event direction in the transmitted-channel domain to information corresponding to an auditory event direction in a playback-channel domain; and the synthesizer is adapted to:

apply a panning law in the playback-channel domain to the pair of playback channels to determine relative power levels for the pair of playback channels; and scale the pair of playback channels based on the determined relative power levels.

24. The invention of claim 23, wherein the synthesizer is further adapted to generate a de-correlated power level for each playback channel based on the coherence cue.

25. The invention of claim 13, wherein:

the E transmitted channels were generated by applying a downmixing operation to C input audio channels; and the synthesizer is adapted to apply an upmixing operation to the E transmitted channels to generate C upmixed channels, wherein the upmixing operation is selected based on the downmixing operation.

26. The invention of claim 20, wherein the E transmitted channels are received without any cues as side information.

27. The invention of claim 20, wherein at least one part of the upmixing is based on matrixing.

28. The invention of claim 20, further comprising means for extracting one or more cues from side information transmitted with the E transmitted channels, wherein the one or more synthesized playback channels are synthesized from the one or more upmixed channels based on the one or more derived cues and the one or more extracted cues.

29. The invention of claim 20, wherein E=2.

30. The invention of claim 20, wherein the E transmitted audio channels correspond to a downmixed surround sound signal generated by applying a downmixing matrix to a surround sound signal.

31. The invention of claim 20, wherein the apparatus is a decoder comprising the cue estimator and the synthesizer.

32. The invention of claim 20, wherein the apparatus is a receiver comprising:

means for receiving the E transmitted channels; and a decoder comprising the cue estimator and the synthesizer.

33. The invention of claim 20, wherein the apparatus is an audio player comprising the cue estimator, the synthesizer, and a plurality of loudspeakers.

34. The invention of claim 20, wherein the cue estimator is adapted to derive cues for different subbands and different times of the E transmitted channels.

35. A non-transitory machine-readable medium, having encoded thereon program code, wherein, when the program code is executed by a machine, the machine implements a method for synthesizing C playback audio channels from E transmitted audio channels, where C>E>I, the method comprising:

deriving one or more cues from the E transmitted channels, wherein the one or more derived cues comprise and a coherence cue, wherein the coherence cue is derived from two of the transmitted channels by:

generating power estimates for each of the two transmitted channels;

generating at least one cross-correlation estimate for the two transmitted channels; and generating the coherence cue based on the power estimates and the cross-correlation estimate;

upmixing one or more of the E transmitted channels to generate one or more upmixed channels; and synthesizing one or more of the C playback channels from the one or more upmixed channels based on the one or more derived cues, including the coherence cue.

36. A transmitter-implemented method for generating E transmitted audio channels from C input audio channels, where C>E>1, the method comprising:

estimating, based on the C input channels, a direction for an auditory event in an input-channel domain;

mapping the auditory event direction in the input-channel domain to an auditory event direction in a transmitted-channel domain;

applying a downmixing matrix to the C input channels to generate E downmixed channels, wherein the downmixing matrix is independent of the auditory event direction;

applying a panning law based on the auditory event direction in the transmitted-channel domain to determine relative power levels for at least two downmixed channels; and scaling the at least two downmixed channels based on the determined relative power levels to generate at least two of the E transmitted channels.

37. The invention of claim 36, wherein the relative power levels for the at least two downmixed channels are determined by applying an amplitude panning law based on a specified angle between two speakers in the transmitted-channel domain and the auditory event direction in the transmitted-channel domain.

38. The invention of claim 36, wherein the auditory event direction is independently estimated and the downmixing algorithm is independently implemented for each of a plurality of subbands in the input channels.

39. The invention of claim 36, wherein the auditory event direction is estimated by generating a sum of power-weighted direction vectors for the input channels, wherein each direction vector is weighted based on determined power level of the corresponding input channel.

40. The invention of claim 36, wherein at least one part of the downmixing algorithm is based on matrixing.

41. The invention of claim 36, wherein the downmixing algorithm involves no crosstalk between left and right sides of the input-channel domain.

42. The invention of claim 36, further comprising the step of transmitting the E transmitted channels without any cues as side information.

43. An apparatus for generating E transmitted audio channels from C input audio channels, where C>E>1, the apparatus comprising:

means for estimating, based on the C input channels, a direction for an auditory event in an input-channel domain;

means for mapping the auditory event direction in the input-channel domain to an auditory event direction in a transmitted-channel domain;

means for applying a downmixing matrix to the C input channels to generate E downmixed channels, wherein the downmixing matrix is independent of the auditory event direction;

means for applying a panning law based on the auditory event direction in the transmitted-channel domain to determine relative power levels for at least two downmixed channels; and means for scaling the at least two downmixed channels based on the determined relative power levels to generate at least two of the E transmitted channels.

44. A non-transitory machine-readable medium, having encoded thereon program code, wherein, when the program code is executed by a machine, the machine implements a method for generating E transmitted audio channels from C input audio channels, where C>E>I, the method comprising:

estimating, based on the C input channels, a direction for an auditory event in an input-channel domain;

mapping the auditory event direction in the input-channel domain to an auditory event direction in a transmitted-channel domain;

applying a downmixing matrix to the C input channels to generate E downmixed channels, wherein the downmixing matrix is independent of the auditory event direction;

applying a panning law based on the auditory event direction in the transmitted-channel domain to determine relative power levels for at least two downmixed channels; and scaling the at least two downmixed channels based on the determined relative power levels to generate at least two of the E transmitted channels.

45. A non-transitory machine-readable medium, having encoded thereon program code, wherein, when the program code is executed by a machine, the machine implements a method for synthesizing C playback audio channels from E transmitted audio channels, where C>E>I, the method comprising:

deriving one or more cues from the E transmitted channels, wherein the one or more derived cues comprise a level-difference cue and a coherence cue, wherein the coherence cue is derived from two of the transmitted channels by:

generating power estimates for each of the two transmitted channels;

generating at least one cross-correlation estimate for the two transmitted channels; and generating the coherence cue based on the power estimates and the cross-correlation estimate;

upmixing one or more of the E transmitted channels to generate one or more upmixed channels; and synthesizing one or more of the C playback channels from the one or more upmixed channels based on the one or more derived cues, including the coherence cue.

46. An audio processing system-implemented method comprising:

generating E audio channels from a multi-channel signal;

transmitting the E audio channels;

receiving the E transmitted audio channels;

deriving one or more cues from the E transmitted channels, wherein the one or more derived cues comprise a coherence cue, wherein the coherence cue is derived from two of the transmitted channels by:

generating power estimates for each of the two transmitted channels;

generating at least one cross-correlation estimate for the two transmitted channels; and generating the coherence cue based on the power estimates and the cross-correlation estimate;

upmixing one or more of the E transmitted channels to generate one or more upmixed channels; and synthesizing one or more of C playback channels from the one or more upmixed channels based on the one or more derived cues, including the coherence cue, where C>E>1.

47. A system comprising:

an encoder apparatus adapted to generate E audio channels from a multi-channel signal and transmit the E audio channels; and a decoder apparatus adapted to:

receive the E transmitted audio channels;

derive one or more cues from the E transmitted channels, wherein the one or more derived cues comprise a coherence cue, wherein the coherence cue is derived from two of the transmitted channels by:

generating power estimates for each of the two transmitted channels;

generating at least one cross-correlation estimate for the two transmitted channels; and generating the coherence cue based on the power estimates and the cross-correlation estimate;

upmix one or more of the E transmitted channels to generate one or more upmixed channels; and synthesize one or more of C playback channels from the one or more upmixed channels based on the one or more derived cues, including the coherence cue, where C>E>I.

* * * * *

UNITED STATES PATENT AND TRADEMARK OFFICE

CERTIFICATE OF CORRECTION

PATENT NO. : 7,787,631 B2
APPLICATION NO. : 11/058747
DATED : August 31, 2010
INVENTOR(S) : Christof Faller It is certified that error appears in the above-identified patent and that said Letters Patent is hereby corrected as shown below:

In column 23, line 6, please replace “C>E>I” with --C>E>1--.

Signed and Sealed this
Twenty-eighth Day of December, 2010

David J. Kappos

David J. Kappos
*Director of the United States Patent and Trademark Office*